US010595649B2

(12) United States Patent
Papic et al.

(10) Patent No.: US 10,595,649 B2
(45) Date of Patent: Mar. 24, 2020

(54) MODULAR COUNTER SYSTEM AND METHOD

(71) Applicant: EVANS CONSOLES CORPORATION, Calgary, Alberta (CA)

(72) Inventors: Matko Papic, Calgary (CA); Carlos Renderos, Calgary (CA); Marie Claire Looze, Rotterdam (NL)

(73) Assignee: EVANS CONSOLES CORPORATION, Calgary, Alberta (CA)

( * ) Notice: Subject to any disclaimer, the term of this patent is extended or adjusted under 35 U.S.C. 154(b) by 0 days.

(21) Appl. No.: 15/712,551

(22) Filed: Sep. 22, 2017

(65) Prior Publication Data

US 2018/0084929 A1 Mar. 29, 2018

Related U.S. Application Data

(60) Provisional application No. 62/398,739, filed on Sep. 23, 2016.

(51) Int. Cl.

| | |
|---|---|
| ***A47F 9/04*** | (2006.01) |
| ***A47F 9/00*** | (2006.01) |
| *A47B 21/03* | (2006.01) |

(52) U.S. Cl.

CPC ..... *A47F 9/04* (2013.01); *A47F 9/00* (2013.01); *A47B 21/03* (2013.01); *A47B 2200/0035* (2013.01); *A47B 2200/0066* (2013.01)

(58) Field of Classification Search

CPC ..... A47B 57/00; A47B 17/00; A47B 17/02; A47B 19/00; A47B 19/08; A47B 21/00;

(Continued)

(56) References Cited

U.S. PATENT DOCUMENTS 804,089 A * 11/1905 Blanc et al. ..... A47B 31/00 312/249.12
2,944,861 A * 7/1960 Lessin ..... A47B 17/02 108/60

(Continued)

FOREIGN PATENT DOCUMENTS

JP H01175806 A 7/1989
JP H0810055 A 1/1996

OTHER PUBLICATIONS http://www.southwestsolutions.com/mission-critical-consoles-workstations/modular-adjustable-computer-workstations-for-dept-of-defense-operations-centers retrieved on Jan. 26, 2016.

(Continued)

*Primary Examiner* — Jose V Chen
(74) *Attorney, Agent, or Firm* — Notaro, Michalos & Zaccaria P.C.

(57) ABSTRACT

Customer service counters with specialized equipment may be used in airports and other settings. Counters in an airport may be used, for example, for ticketing, check-in, and baggage drop off services. Some aspects of the disclosure provide a modular counter system including a counter comprising at least one counter section. Each counter section includes a respective upper panel comprising a respective work surface, and a respective equipment pedestal bay, below the upper panel, for receiving one or more respective portable equipment pedestals therein. The system may further include the one or more respective portable equipment pedestals for each counter section. Each portable equipment pedestal is receivable within the corresponding equipment pedestal bay. The portable equipment pedestals may be configured for a particular user and/or service and may be swapped with one or more other pedestals configured for a different user and/or service.

19 Claims, 24 Drawing Sheets

(58) Field of Classification Search

CPC ..... A47B 21/02; A47B 2200/0067; A47B 2200/0075; A47B 2200/0077; A47B 2200/0078; A47B 2200/0079; A47B 2200/13; A47F 5/005

USPC ..... 108/50.01, 50.02, 60, 64, 107, 110; 312/194, 195, 196, 209, 237, 223.3, 312/140.1, 140.4

See application file for complete search history.

(56) References Cited

U.S. PATENT DOCUMENTS

| | | | | | |
|---|---|---|---|---|---|
| 3,083,417 | A * | 4/1963 | Cook | A47B 41/00 | 108/60 |
| 3,588,210 | A * | 6/1971 | Des Marais | A47B 41/00 | 108/60 |
| 4,138,815 | A | 2/1979 | Williams et al. | | |
| 4,378,727 | A * | 4/1983 | Doss | F24F 7/08 | 108/50.13 |
| 4,555,150 | A * | 11/1985 | Turnbull | A47B 17/033 | 312/195 |
| 4,932,332 | A * | 6/1990 | Noda | A47B 37/00 | 108/143 |
| 5,088,421 | A * | 2/1992 | Beckstead | A47B 9/12 | 108/147 |
| 5,130,494 | A * | 7/1992 | Simonton | A47B 21/06 | 108/23 |
| 5,205,629 | A * | 4/1993 | Simons | A47B 17/033 | 312/228 |
| 5,205,631 | A * | 4/1993 | Wegman | A47B 21/0314 | 312/208.1 |
| 5,598,789 | A | 2/1997 | Jonker | | |
| 5,609,402 | A | 3/1997 | Kemp | | |
| 5,741,053 | A * | 4/1998 | Nielsen | A47B 21/00 | 312/194 |
| 6,055,912 | A | 5/2000 | Doud et al. | | |
| 6,170,410 | B1 * | 1/2001 | Gioacchini | A47B 87/002 | 108/153.1 |
| D437,706 | S * | 2/2001 | Alcala | D6/671 | |
| 6,283,043 | B1 * | 9/2001 | Stern | A47B 13/06 | 108/50.02 |
| 6,926,160 | B2 * | 8/2005 | Perkins | A47B 21/06 | 211/189 |
| 6,926,376 | B2 * | 8/2005 | Arent | B25H 1/02 | 312/194 |
| 6,935,247 | B2 * | 8/2005 | Schaefers | A47B 21/00 | 108/50.01 |
| 7,004,081 | B2 * | 2/2006 | Chang | A47B 21/03 | 108/50.01 |
| 7,147,290 | B2 * | 12/2006 | Arent | B25H 1/02 | 312/249.9 |
| 7,258,317 | B1 * | 8/2007 | Nagel | A47B 96/025 | 108/108 |
| 10,039,376 | B2 * | 8/2018 | Vander Park | A47B 21/02 | |
| 2002/0108539 | A1 * | 8/2002 | Dahl | A47B 21/00 | 108/50.01 |
| 2004/0124751 | A1 * | 7/2004 | Arent | B25H 1/02 | 312/249.9 |
| 2008/0315733 | A1 * | 12/2008 | Bosch | A47B 21/0073 | 312/223.3 |
| 2010/0024688 | A1 * | 2/2010 | Kitada | A47B 21/00 | 108/50.02 |
| 2011/0168063 | A1 * | 7/2011 | Rotlevi | A47B 21/00 | 108/50.11 |
| 2014/0312754 | A1 * | 10/2014 | Hecht | A47B 9/04 | 312/309 |
| 2015/0083028 | A1 * | 3/2015 | Bedard | A47B 83/04 | 108/64 |
| 2015/0150371 | A1 | 6/2015 | Fish | | |
| 2015/0327671 | A1 | 11/2015 | Symonds et al. | | |
| 2016/0128495 | A1 * | 5/2016 | Looze | A47B 81/00 | 312/198 |

OTHER PUBLICATIONS http://www.wayfair.com/Rush-Furniture-Modular-Real-Oak-Wood-Veneer-Standard-Computer-Desk-Office-Suite-RSH1107.html retrieved on Jan. 26, 2016.

http://www.alibaba.com/product-detail/Straight-Workstation-25mm-Particle-Board-Top_60134414993.html retrieved on Jan. 26, 2016.

http://www.alibaba.com/product-detail/2-Mobile-Cabinet-Computer-Table-Straight_60136137089.html retrieved on Jan. 26, 2016.

http://www.hayneedle.com/product/gladiatormobileworkstation.cfm retrieved on Jan. 26, 2016.

Extended European Patent Search Report for corresponding European Patent Application EP 17192625, dated Nov. 7, 2017.

* cited by examiner

MODULAR COUNTER SYSTEM AND METHOD

RELATED APPLICATION

This application claims priority to U.S. Provisional Patent Application Ser. No. 62/398,739, filed on Sep. 23, 2016, the entire content of which is incorporated herein by reference.

FIELD OF THE DISCLOSURE

Aspects of the disclosure relate to customer service counters. In particular, aspects of the disclosure relate to counters that may be used in airports or similar environments.

BACKGROUND

Customer service counters with specialized equipment may be used in airports and other settings. Customer service counters in an airport may be used, for example, for ticketing, check-in, and baggage drop off services. Such counters may typically include one or more work surfaces for a worker at the counter as well as one or more work surfaces for a customer. The counter will typically include equipment for the attendant to use including a computer including a display and specialized equipment such as one or more printers for baggage tags, tickets and/or boarding passes, etc.

The layout and/or configuration of equipment at a counter may need to be customized or changed for different workers (e.g. between shifts) or in order to perform different customer services using the counter. For example, it may be desirable to swap out equipment at the counter. However, it may be cumbersome and/or arduous to make such equipment changes in conventional counters.

SUMMARY

According to one aspect, there is provided a modular counter system comprising: a counter comprising at least one counter section, each said counter section comprising: a respective upper panel comprising a respective work surface; and a respective equipment pedestal bay, below the upper panel, for receiving one or more respective portable equipment pedestals therein.

In some embodiments, the counter has a front for facing a first user and a back for facing a second user, and the equipment pedestal bay is open at the front of the counter.

In some embodiments, each said counter section comprises: a first side wall; a second side wall opposite to the first side wall; and a back wall extending between the first and second side walls.

In some embodiments, the at least one counter section comprises first and second adjacent counter sections, the second side wall of the first counter section being the first side wall of the second counter section.

In some embodiments, the system further comprises, for each said counter section, a respective spacer panel below the upper panel, wherein the spacer panel, the first and second side walls, and the back wall of the counter section collectively define the respective equipment pedestal bay.

In some embodiments, the counter is configured to rest on a floor, and for each said counter section, the respective equipment pedestal bay extends from the spacer panel to the floor.

In some embodiments, the system further comprises, for each said counter section, the one or more respective portable equipment pedestals, wherein each said portable equipment pedestal is receivable within the corresponding equipment pedestal bay.

In some embodiments, for each said counter section, the one or more respective portable equipment pedestals comprise a first portable equipment pedestal and a second portable equipment pedestal, and the first and second portable equipment pedestals, when positioned adjacent to each other within the equipment pedestal bay, substantially fill the respective equipment pedestal bay of the counter section.

In some embodiments, each of the portable equipment pedestals defines a respective plurality of equipment storage spaces therein for holding equipment to be used at the counter.

In some embodiments, the equipment to be used at the counter comprises equipment for use in airport customer service.

In some embodiments, each said one or more portable equipment pedestal comprises respective wheels for moving the portable equipment pedestal over a floor and into the corresponding equipment pedestal bay of the counter.

In some embodiments, for each said counter section, the respective upper panel is vertically adjustable.

In some embodiments, for each said counter section, the respective upper panel is mounted to a respective vertical lift that is controllable to vertically move the upper panel to provide said vertical adjustment.

In some embodiments, the modular counter is configured as a standing counter.

In some embodiments, the system further comprises a baggage weigh scale.

In some embodiments, for each said counter section, the one or more portable equipment pedestals comprises: a first one or more portable equipment pedestals; and a second one or more portable equipment pedestals, wherein the first one or more portable equipment pedestals is swappable with the second one or more equipment pedestals.

According to another aspect, there is provided a method for a modular counter system, the modular counter system comprising at least one respective equipment pedestal bay, the method comprising: for each said equipment pedestal bay, providing a respective first one or more portable equipment pedestals; and for each said equipment pedestal bay, moving the respective first one or more portable equipment pedestals into the equipment pedestal bay.

In some embodiments, the method further comprises, for each said equipment pedestal bay, replacing at least one of the first respective first one or more portable equipment pedestals with a second one or more portable equipment pedestals.

In some embodiments, the first one or more portable equipment pedestals comprises equipment configured for a first user and the second one or more portable equipment pedestals comprises equipment configured for a second user.

In some embodiments, the first one or more portable equipment pedestals comprises equipment configured for a first customer service and the second one or more portable equipment pedestals comprises equipment configured for a second customer service.

In some embodiments, the modular counter system further comprises at least one upper panel, each said upper panel having a respective work surface, the method further comprising vertically adjusting a position of one or more of said at least one upper panel.

Other aspects and features of the present disclosure will become apparent to those ordinarily skilled in the art, upon review of the following description of example embodiments.

BRIEF DESCRIPTION OF THE DRAWINGS

Embodiments of the disclosure will now be described in greater detail with reference to the accompanying diagrams, in which.

DETAILED DESCRIPTION

Figure 1:
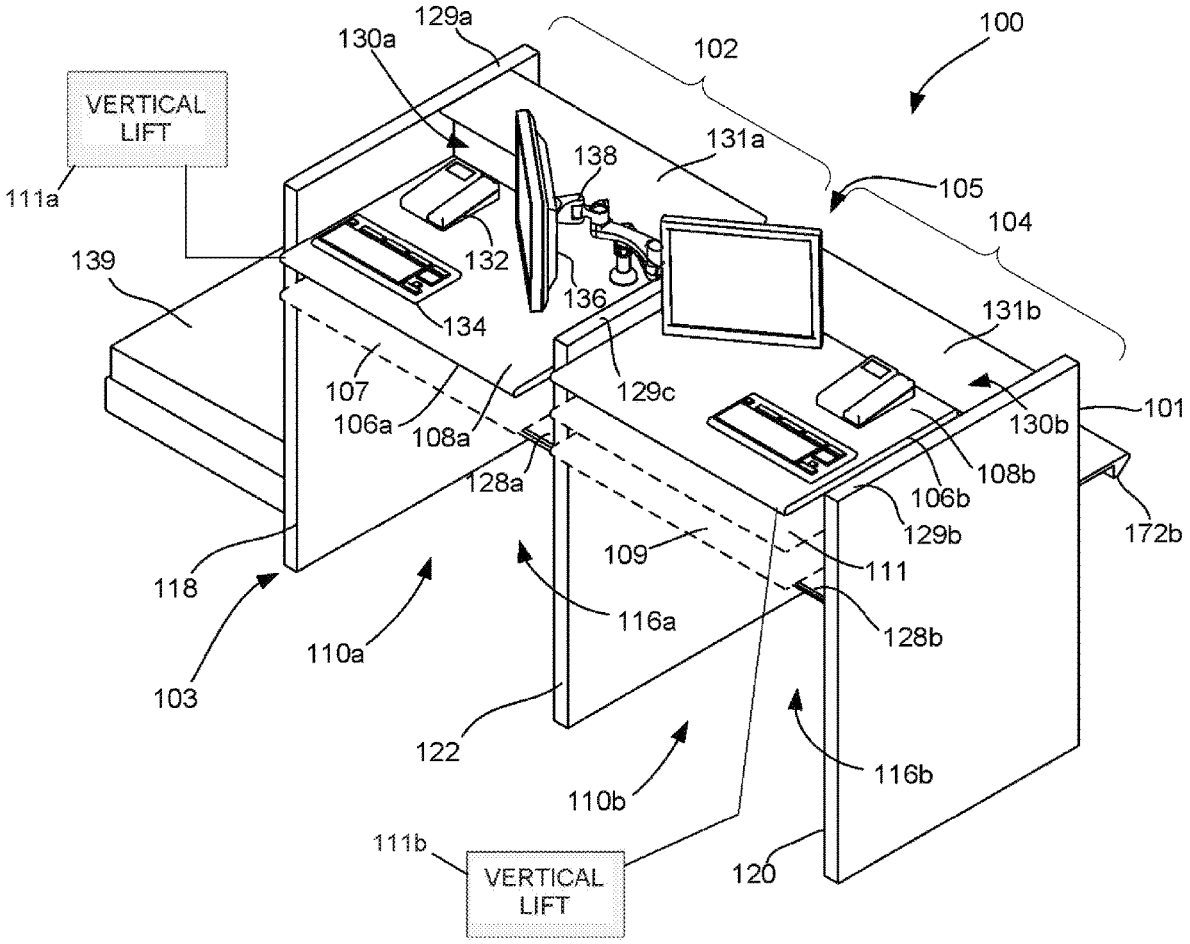
FIG. 1 is a front perspective view of a counter according to one embodiment.

As mentioned above, counters are often used in an airport setting for ticketing, check-in, baggage tagging etc. Typically, counters for such services may be configured for workers and customers to be standing at the counters. It may be desirable for such counters to be configurable and/or customizable for different services and/or different workers. The example counters described herein are for use in an airport. However, it is to be understood that aspects of the disclosure are not limited to airport use.

It is to be understood that references herein to orientations such as "front", "rear", "side", "back" or to directions such as "forwards", "rearward", etc. are for ease of description and are not intended to limit the orientation of the counters described herein and shown in the figures. Similarly, the terms "horizontal" and "vertical" do not imply absolutely horizontal or plumb, but are instead used generally. For example, a "vertical" element is not necessarily perfectly vertical, but may be slightly angled and/or may be curved or bent. Any dimensions specified in the drawings or description below are also shown by way of example, and embodiments are not limited to such dimensions.

A modular counter system according to some embodiments includes a counter defining one or more bays or spaces for receiving one or more portable equipment pedestals. The term "bay" refers to any space suitable to receive one or more equipment pedestals. The bay(s) may, for example, be generally box shaped with an open front through which the one or more equipment pedestals are received.

The modular counter system may further include the one or more portable equipment pedestals. The term "equipment pedestal" herein refers to any structure for bearing equipment to be used in conjunction with the counter system. For example, an equipment pedestal may be in the form of a cart, portable cabinet and/or shelf structure, or other upright support structure. A portable equipment pedestal may be outfitted with equipment such as one or more printers, scanners, computers, etc. The equipment may be customized for one or more particular customer services including, but not limited to, airport services (ticketing, baggage check, etc.) and/or car rental services. Portability of the equipment pedestal may be provided by wheels, rollers, tracks, handles (to allow carrying, pulling or pushing) etc. Embodiments are not limited to any particular means for porting the equipment pedestals.

Figure 2:
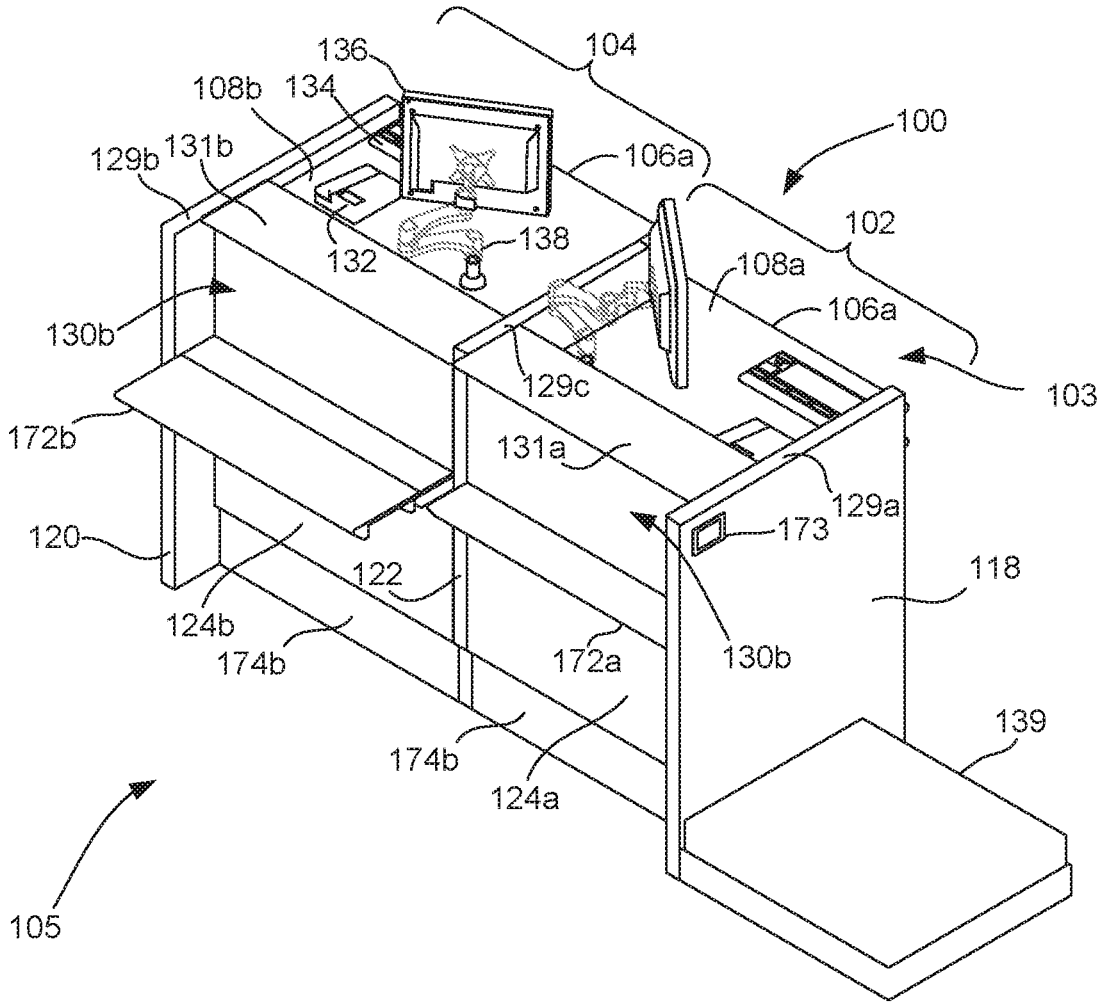
FIG. 2 is a rear perspective view of the counter of FIG. 1 according to one embodiment.

FIGS. 1 and 2 are front and rear perspective views, respectively, of a counter 100 according to some embodiments. The counter 100 is sized to be a standing counter, where customers and/or the attendant using the counter may stand while using the counter, although embodiments are not limited to a standing counter arrangement. As will be explained below, the counter 100 may be customized or modified for various uses. The counter 100 may be used, for example, in an airport and be configured for ticketing, baggage drop and/or check-in services. The counter 100 may be also be configured for other services, such as car rental services. Embodiments are not limited to a particular configuration or use of the counter 100.

The counter 100 includes first counter section 102 and a second counter section 104 adjacent to the first counter section 102. Other embodiments may only include a single section or may include three or more sections. The counter has a front 103 for facing first user (e.g. worker) and a back 105 for facing a second user (e.g. customer).

Each of the first and second counter sections 102 and 104 includes a respective upper panel 106*a* or 106*b*. Each upper panel 106*a* and 106*b* provides a respective work surface 108*a* or 108*b*.

As shown in FIG. 1, the first and second counter sections 102 and 104 each define a respective equipment pedestal bay 110*a* or 110*b*. The equipment pedestal bays 110*a* and 110*b* each have a generally rectangular or box-like shape in this example, although embodiments are not limited to such shapes. The equipment pedestal bays 110*a* and 110*b* are located below the corresponding upper panel 106*a* and 106*b* and each receive one or more respective portable equipment pedestals therein.

Figure 3:
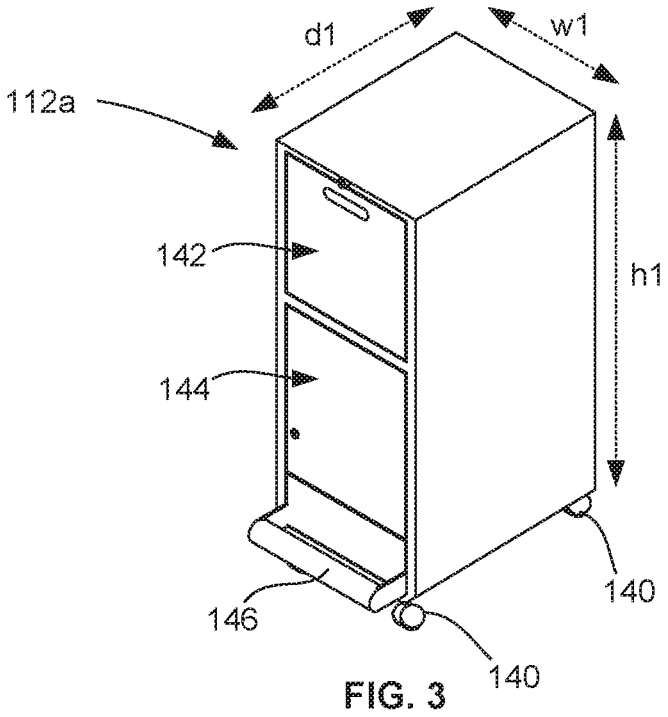
FIG. 3 is a front perspective view of a first example portable equipment pedestal for the counter of FIGS. 1 and 2.
Figure 4:
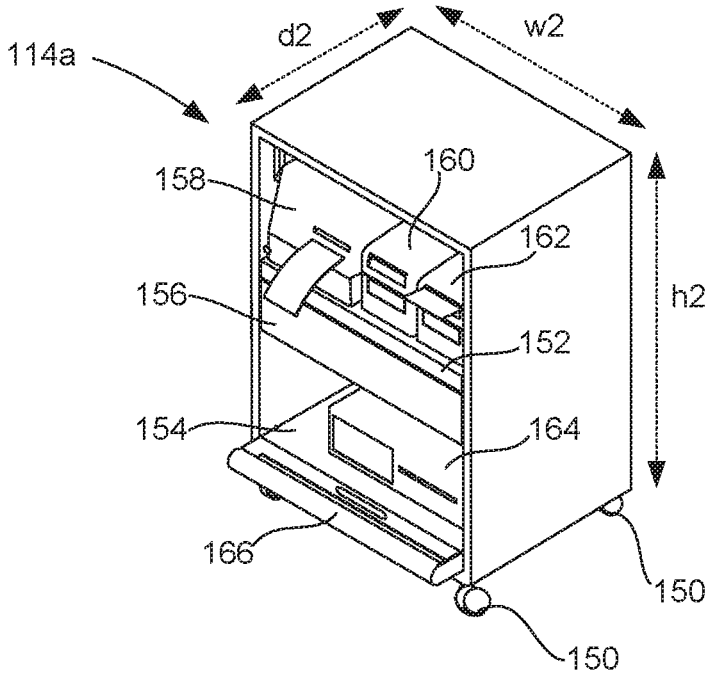
FIG. 4 is a front perspective view of a second example portable equipment pedestal for the counter of FIGS. 1 and 2.

A modular counter system 101 (shown in FIG. 5) in this example includes the counter 100 of FIGS. 1 and 2 and one or more portable equipment pedestals receivable in the equipment pedestal bays 110*a* and 110*b*. Example first and second portable equipment pedestals 112*a* and 114*a* are shown in FIGS. 3 and 4 respectively and are discussed in more detail below. Each equipment pedestal bay 110*a* and 110*b* has a respective open front 116*a* or 116*b* (at the front 103 of the counter 100) through which the corresponding pairs of portable equipment pedestals 112*a* and 114*a*, or 112*b* and 114*b* are received. The portable equipment pedestals 112*a*, 112*b*, 114*a* and 114*b* (FIGS. 3 and 4) are removable and may be swapped with other portable equipment pedestals to change the configuration and/or function of the counter 100. Thus, the counter system 101 is "modular" in that the equipment pedestals 112*a* and 114*a* are replaceable modules to facilitate customization for individual users and/or customer services.

Referring again to FIGS. 1 and 2, the counter 100 in this embodiment includes a first side wall 118 and a second side wall 120 opposite to the first side wall 118. The housing also includes an intermediate wall 122 between the first side wall 118 and the second side wall 120. The intermediate wall 122 in this embodiment acts as a divider between the first and second counter sections 102 and 104 (in effect, forming a side wall for each counter section 102 and 104). Thus, the first counter section 102 includes first side wall 118 and the intermediate wall 122 as opposite sides thereof, and the second counter section 104 includes the second side wall 120 and the intermediate wall 122 as opposite sides thereof. The first counter section 102 includes a first back wall 124*a* (shown in FIG. 2) extending between the first side wall 118 and the intermediate wall 122. The second counter section 104 includes a second back wall 124*b* (shown in FIG. 2) extending between the second side wall 120 and the intermediate wall 122.

The counter 100 is optionally configured to be compliant with the Americans with Disabilities Act (ADA) standards. More specifically, in this example embodiment, the first and second counter sections 102 and 104 each include a respective pull out shelf 172*a* or 172*b* that is ADA compliant. The pull-out shelves 172*a* and 172*b* have extended and retracted positions. The shelves 172*a* and 172*b* may be available for customers to use when interacting with a worker at the counter 100. The pull-out shelves 172*a* and 172*b* are optionally positioned at a height that is lower than the upper panels 106*a* and 106*b*. In this example, they are positioned at approximately two thirds of the height of the counter 100. Such pull out shelves 172*a* and 172*b* may be omitted in other embodiments.

In other embodiments, rather than a single, shared intermediate wall 122, two adjacent intermediate walls (one for each counter section 102 and 104) may be used. In other words, the first counter section 102 may include two spaced apart side walls, and the second counter section 104 may include two different, spaced apart side walls. In such embodiments, the first and second counter sections 102 and 104 may be unconnected and/or otherwise separable.

As shown in FIG. 1, each counter section 102 and 104 includes a respective horizontally oriented spacer panel 128*a* or 128*b* below each upper panel 106*a* and 106*b*. Each spacer panel 128*a* and 128*b* forms a ceiling of the corresponding equipment pedestal bay 110*a* and 110*b*. The spacer panels 128*a* and 128*b* may be omitted in some embodiments. The spacer panel 128*a* in the first counter section 102 is attached to and extends between the first side wall 118 and the intermediate wall 122. The spacer panel 128*b* in the second section 104 is attached to and extends between the second side wall 120 and the intermediate wall 122.

Thus, the equipment pedestal bay 110*a* of the first counter section 102 is defined by the first side wall 118, the intermediate wall 122, the first back wall 124*a*, the spacer panel 128*a* and the floor surface (not shown) on which the counter 100 sits. The equipment pedestal bay 110*b* of the second counter section 104 is formed by the second side wall 120, the intermediate wall 122, the second back wall 124*b*, the respective spacer panel 128*b* and the floor surface. In other embodiments, the counter 100 may further include one or more bottom panels that sit on the floor surface and defines a bottom of the equipment pedestal bays 110*a* and 110*b*.

Referring again to FIGS. 1 and 2, each counter section 102 and 104 optionally includes a respective upper-rear counter portion 130*a* or 130*b*. The upper-rear counter portion 130*a* of the first section 102 is generally rectangular prism shaped and extends between the intermediate wall 122 and the first and second side walls 118 and 120 and extends upward from the spacer panel 128*a*. The upper-rear counter portion 130*a* also provides an optional secondary work surface 131*a* that is (optionally) generally aligned with upper edges 129*a*, 129*b* and 129*c* of the first side wall 118, the second side wall 120 and the intermediate wall 122. The upper-rear counter portion 130*b* of the second counter section 104 matches the structure and configuration of the first counter section 102, providing a corresponding secondary work surface 131*b*. The upper-rear counter portions 130*a* and 130*b* may provide structural support and may also provide storage space for cables or other equipment. The secondary work surfaces 131*a* and 131*b* may, for example, be used by customers served at the counter 100. The upper-rear counter portions 130*a* and 130*b* are discussed in more detail below with reference to FIGS. 7 and 8.

The upper-rear counter portions 130*a* and 130*b*, the spacer panels 128*a* and 128*b*, and the back walls 124*a* and 124*b* collectively interconnect the first side wall 118, the second side wall 120 and the intermediate wall 122 to form the first and second counter sections 102 and 104 as shown in FIGS. 1 and 2. These components of the counter 100 may be connected using any suitable fastening means (e.g. screws, nails, rivets, adhesives, etc.).

The upper panels 106*a* and 106*b* are vertically adjustable in the embodiment of FIGS. 1 and 2. The upper panel 106*a* of the first counter section 102 is shown at a different height than the upper panel 106*b* of the second counter section 104. Stippled lines show other, non-limiting, possible vertical positions 107, 109 and 111 for the upper panels 106*a* and 106*b*. In this example, a powered vertical lift 111*a* and 111*b* is connected to each upper panel 106*a* and 106*b* to drive and control the vertical adjustment. For example, the motor may include a sliding or telescoping actuator that provides the vertical adjustment. The upper panels 106*a* and 106*b* may, for example, be adjusted between at least two heights (such as a "sitting" height and a "standing height" for work).

Alternatively, mounting hardware (not shown) may be included for mounting the upper panels 106*a* and 106*b*, for example at multiple discrete vertical positions. For example, brackets or other means (not shown) for supporting the upper panels 106*a* and 106*b* may be included on the first side wall 118, the second side wall 120, and the intermediate wall 122. Alternatively, a vertical adjustment mechanism such as an adjustable arm or mount (not shown) may be attached to the counter 100. Any suitable vertical adjustment mechanism for a work surface may be used.

Example equipment including a phone 132, a keyboard 134 and a monitor 136 mounted on an adjustable arm 138 are shown on the work surface 108*a* of the upper panel 106*a* for the first counter section 102. Similar equipment is included on the second counter section 104. However, embodiments are not limited to any particular equipment used with the counter 100.

The counter 100 optionally includes a weigh scale 139. The weigh scale 139 may be configured for weighing baggage being checked at the airport. The weigh scale 139 may be located adjacent to the counter 100 as shown in FIG. 1. Other equipment may also be attached to the counter in addition to, or in place of, the weigh scale 139.

The components of the counter 100 (including but not limited to the first side wall 118, the second side wall 120 and the intermediate wall 122, the first and/or the second back walls 124 and 124*b*) may be constructed in various ways. For example, the counter 100 may include an interior frame and outer cladding or panels may be placed on the frame to form the various components discussed above. As another example, solid cut-outs of material such as wood may be used. Alternatively, sheet metal may be folded in the desired shape. Mixes of these approaches may also be used. For example, the first side wall 118, the second side wall 120 and the intermediate wall 122 may be made using sheet metal, such as stainless steel, while the remainder of the counter 100 is made using wood or imitation wood products. The counter 100 may also include various additional structural support members (not shown) such as brackets or other frame pieces (not shown) to join and/or support the various components. A person skilled in the art will appreciate that the particular hardware, materials and method of assembling the counter 100 may vary, and embodiments are not limited to a particular construction.

As seen in FIG. 2, the first and second side walls 118 and 120 optionally extend rearward past the first and second back walls 124*a* and 124*b*. Each of the first and second back walls 124*a* and 124*b* optionally include a respective, slightly recessed bottom portion 174*a* or 174*b*. For example, if the counter is approximately 46 inches tall, the recessed portions 174*a* and 174*b* may be about 8 inches tall and recessed by about 1 or 2 inches, although embodiments are not limited to these dimensions. The intermediate wall 122 is aligned with the first and second back walls 124*a* and 124*b*.

Optional weigh scale readout 173 is also shown in FIG. 2. The baggage scale readout 173 is a display that is operatively connected to the weigh scale 139 to provide a read out of the weight of baggage placed on the weigh scale 139.

FIG. 3 is a front perspective view of a first portable equipment pedestal 112*a* according to some embodiments. The first portable equipment pedestal 112*a* is in the form of a generally rectangular cabinet or container on wheels 140, which provide portability. The first portable equipment pedestal 112*a* has a height h1, a depth d1 and a width w1. The portable equipment pedestal 112*a* includes an upper cabinet space 142 and a lower cabinet space 144. The upper and lower cabinet spaces 142 and 144 are drawers in this example, but any other storage area for holding equipment that may be used by a worker or other user at the counter 100 in FIGS. 1 and 2. Embodiments are not limited to the particular upper and lower cabinet spaces 142 and 144 shown in FIG. 3. Any suitable one or more equipment storage spaces configured for the desired functionality of the counter 100 may be provided. For example, other equipment pedestals may include shelves, recesses, racks or other spaces for equipment storage and/or mounting.

The first portable equipment pedestal 112*a* also includes a lower bar 146 that may be gripped for moving the first portable equipment pedestal 112*a*.

FIG. 4 is a front perspective view of a second portable equipment pedestal 114*a* according to some embodiments. The second portable equipment pedestal 114*a* is in the form of a rectangular equipment shelving unit on wheels 150, which provide portability. The second portable equipment pedestal 114*a* has a height h2, a depth d2 and a width w2.

The second portable equipment pedestal 114*a*, in this example, includes an open upper shelf 152, an open lower shelf 154 and a front panel 156 between the upper shelf 152 and the lower shelf 154. Example equipment including a ticket printer 158, a first baggage printer 160 and a second baggage printer 162 is shown on the upper shelf 152. A computer 164 is shown on the lower shelf 154. The front panel 156, ticket printer 158, and computer 164 are also visible in FIG. 7. Such equipment may be used for ticketing, baggage tagging, and/or check-in functions in the airport. However, embodiments are not limited to this type of equipment or functionality. For example, portable equipment pedestals in other embodiments may be provided with equipment for car rental or other customer services. In embodiments where the portable equipment pedestal (such as the second portable equipment pedestal 114*a*) is configured for a car rental service, similar, printers, computers, etc. may be stored and accessed in similar ways.

The second pedestal 114*a* also includes a lower bar 166 that may be gripped for moving the second pedestal 114*a*.

The first and second portable equipment pedestals 112*a* and 114*a* in FIGS. 3 and 4 are sized to fit together within one of the first and second equipment pedestal bays 110*a* and 110*b* shown in FIG. 1. In this particular example, the height h1 and depth d1 of the first portable equipment pedestal 112*a* in FIG. 3 is approximately the same as the height h2 and depth d2 of the second portable equipment pedestal 114*a* in FIG. 4 (although this is not required in all embodiments). The second portable equipment pedestal 114*a*, however, has a greater width w2 than the first portable equipment pedestal 112*a*. The total width of the first and second portable equipment pedestals 112*a* and 114*a* is slightly less than the width of either of the first and second equipment pedestal bays 110*a* and 110*b*. Similarly, the height (h1 and h2) and depth (d1 and d2) of the first and second portable equipment pedestals 112*a* and 114*a* is chosen to fit within the height and depth of the first and second equipment pedestal bays 110*a* and 110*b*. Thus, the first and second portable equipment pedestals 112*a* and 114*a* are configured to fit adjacent to each other and be fully received in a given one of the equipment pedestal bays 110*a* and 110*b* of the counter 100 (shown in FIG. 1). The first and second portable equipment pedestals 112*a* and 114*a* substantially fill the corresponding equipment pedestal bay 110*a* or 110*b*.

Figure 5:
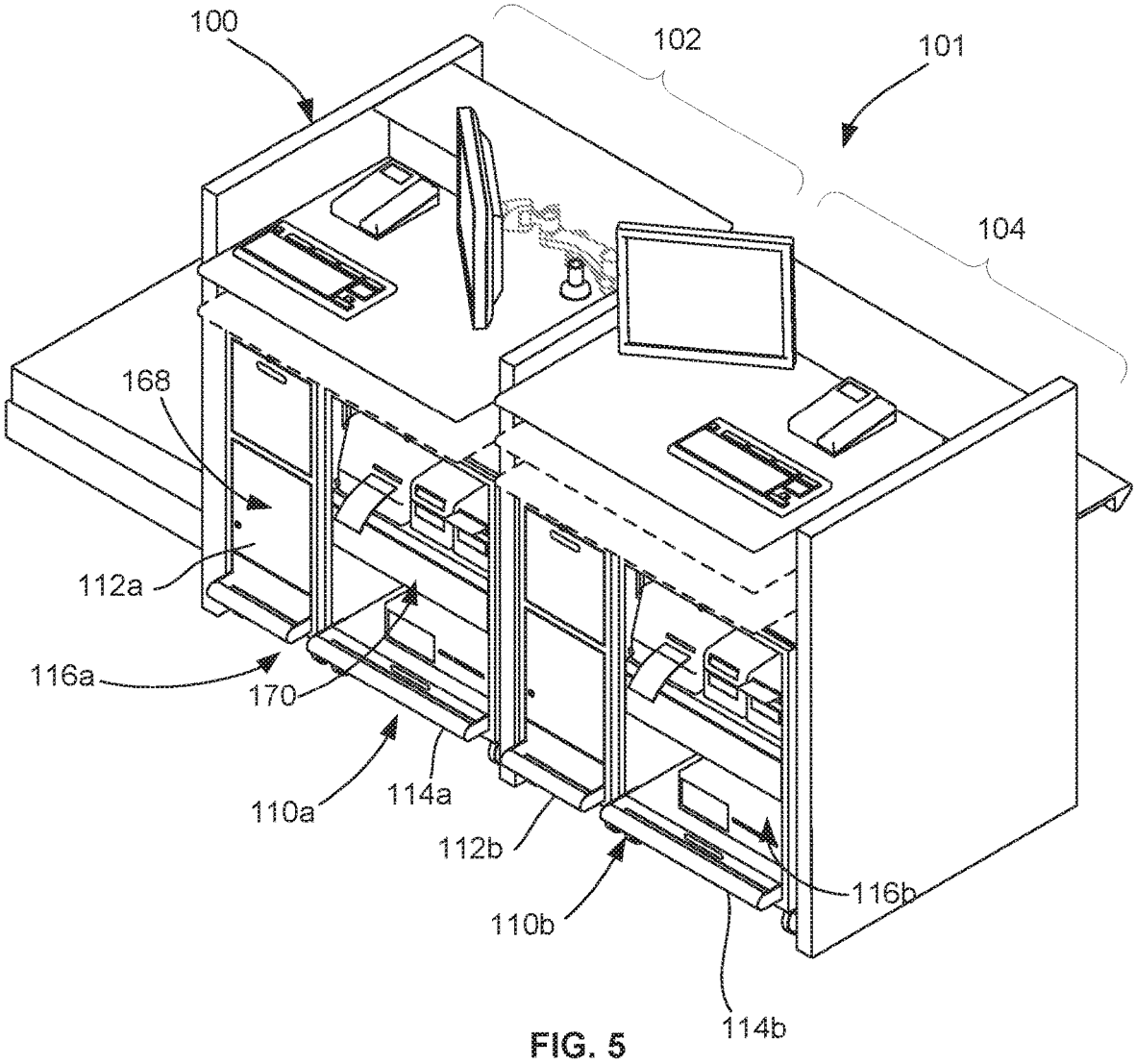
FIG. 5 is a front perspective view of a modular counter system including the counter of FIGS. 1 and 2 and the portable equipment pedestals of FIGS. 3 and 4.

FIG. 5 is a front perspective view of the modular counter system 101, including the counter 100, a first pair of first and second portable equipment pedestals 112*a* and 114*a*, and a second pair of first and second portable equipment pedestals 112*b* and 114*b*. The first pair of first and second portable equipment pedestals 112*a* and 114*a* are received in the equipment pedestal bay 110*a* of the first counter section 102. The second pair of first and second portable equipment pedestals 112*b* and 114*b* are received in the equipment pedestal bay 110*b* of the second counter section 104. The first and second portable equipment pedestals 112*a* and 114*a* of the first counter section 102 have fronts 168 and 170 that are substantially aligned with the front 116*a* of the equipment pedestal bay 110*a*. The first and second portable equipment pedestals 112*b* and 114*b* of the second counter section 104 are similarly aligned with the front 116*b* of the corresponding equipment pedestal bay 110*b*.

The portable equipment pedestals 112*a*, 112*b*, 114*a* and 114*b* may each be wheeled along the floor surface (not shown) under the counter 100. The counter 100 has no bottom panel or surface of its own, which may allow the first and second portable equipment pedestals 112*a*, 112*b*, 114*a* and 114*b* to be wheeled into the equipment pedestal bays 110*a* and 110*b* without needing to move over a bump or floor level change. However, as mentioned above, in other embodiments, the counter 100 may include a bottom panel or surface, in which case the portable equipment pedestals 112*a*, 112*b*, 114*a* and 114*b* may be wheeled onto that bottom panel or surface when entering the equipment pedestal bays 110*a* and 110*b*.

The counter 100 is modular in that one or more of the first and second portable equipment pedestals 112*a*, 112*b*, 114*a* and 114*b* may be swapped for one or more similar or different pedestals. The other pedestals may include similar or differently configured equipment (e.g. customized for a particular worker or customer service). The other pedestals may also have a different size (height, width and/or depth) and structure. For example, the first pair of portable equipment pedestals 112*a* and 114*a* could be swapped for a single equipment pedestal sized to fill the equipment pedestal bay 110*a*. Alternatively, two or more differently sized and configured pedestals may replace the first pair of portable equipment pedestals 112*a* and 114*a*. One or both of the second pair of portable equipment pedestals 112*a* and 114*a* may similarly be swapped out. By allowing equipment pedestal swapping and vertical adjustment of the upper panels 106*a* and 106*b*, the counter 100 may be quickly customized to meet the needs of different users (e.g. workers and/or customers). The users may be attendants or workers at the airport, for example. Between worker shifts, the equipment pedestals for the worker whose shift is ending may be replaced with equipment pedestals customized for the worker starting the new shift. The upper panel 106*a* or 106*b* may be adjusted to a height comfortable for the new worker.

Optionally, the counter 100 may be re-configured for an entirely new customer service by swapping one or more of the portable equipment pedestals 112*a*, 112*b*, 114*a* and 114*b* and/or by keeping one or more portable equipment pedestals 112*a*, 112*b*, 114*a* and 114*b* while swapping out equipment within that one or more equipment pedestals 112*a*, 112*b*, 114*a* and 114*b*. For example, a modular counter (such as the counter 100 shown in FIG. 1) may include equipment pedestals for check-in and baggage tagging. Then, for a second mode, those equipment pedestals may be swapped with one or more new equipment pedestals configured for ticket purchasing and issuing functions. As another example, the counter 100 may be reconfigured for car rental services or other customer services.

Thus, as described above, the counter 100 may thereby be customizable in form and/or function. Furthermore, one or more equipment pedestals may be omitted, and at least a portion of the equipment pedestal bays 110*a* and 110*b* may be left empty or filled with other structure and/or equipment. Thus, the counter 100 may also be customized such that a user such as a worker may sit at a chair with the user's legs extending into the equipment pedestal bay 110*a* and/or 110*b*. In addition, the number of counter sections (such as counter sections 102 and 104) may be customized.

Figure 6:
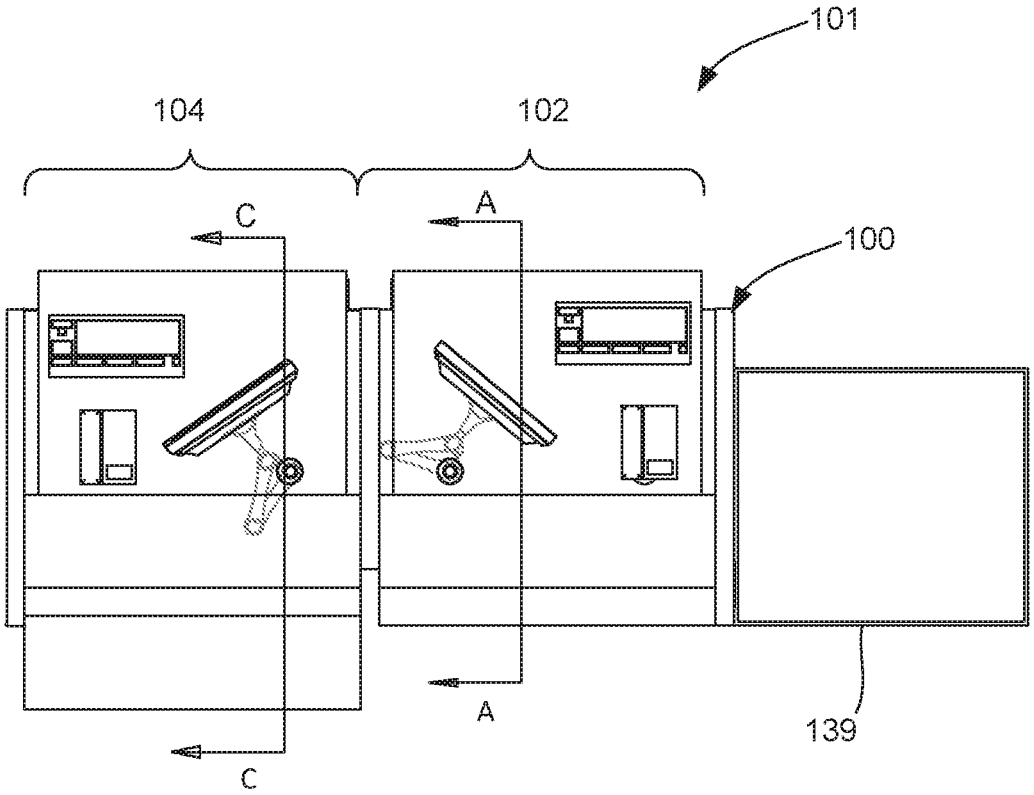
FIG. 6 is a top view of the modular counter system of FIG. 5.

FIG. 6 is a top view of the modular counter system 101 of FIG. 5 and shows the first and second counter sections 102 and 104 of the counter 100 and weigh scale 139.

Figure 7:
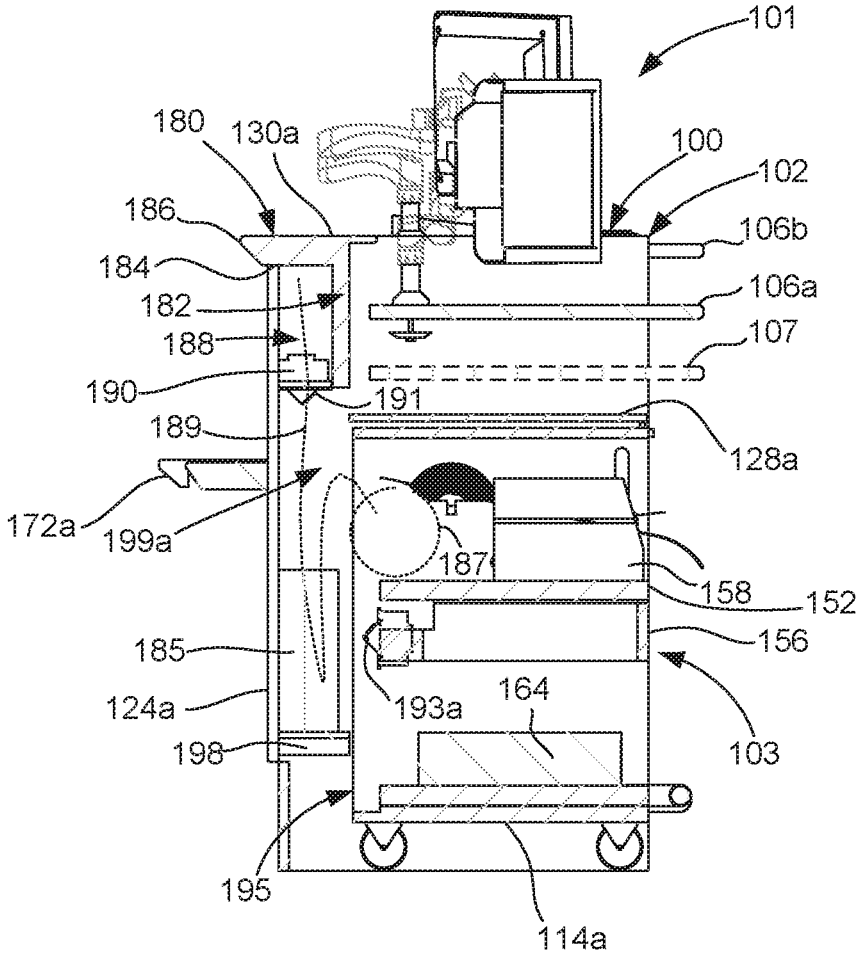
FIG. 7 is a cross sectional view of the modular counter system taken along the line A-A in FIG. 6.

FIG. 7 is a side cross-sectional view of the modular counter system 101 taken along the line A-A, through the first counter section 102, in FIG. 6. The cross-sectional view of FIG. 7 includes a cross-section of the second portable equipment pedestal 114*a*. In this example, upper panels 106*a* and 106*b* are shown, and an optional position 107 of the upper panel 106*a* is shown in stippled lines for illustrative purposes.

As shown in FIG. 7, the upper-rear counter portion 130*a* includes a flat horizontal top panel 180 and a downward extending vertical panel 182 that together form a generally upside down L-shaped cross-sectional profile. The top panel 180 is arranged over a top edge 184 of the first back wall 124*a*, and that top panel 180 engages the first back wall 124*a* near an outer edge 186 of the top panel 180. The vertical panel 182 of the upper-rear counter portion 130*a* is positioned a distance away from the back wall 124*a* to form a space 188 (e.g. about 6 inches deep) between the back wall 124*a* and the vertical panel 182. Electrical power/data connection box 190 and row of power outlets 191 and/or data connection ports is attached between the upper-rear counter portion 130*a* and the first back wall 124*a* and at the bottom of the space 188. The upper-rear counter portion 130*b* of the second counter section 104 (shown in FIG. 1) has a similar structure and arrangement as the first upper-rear counter portion 130*a* of the first counter section 102. A lower-rear enclosure 185 is also shown by way of example. Equipment such as a router, computer, thin client, etc. may be stored in the lower-rear enclosure 185. Alternatively, the space occupied by lower-rear enclosure 185 may be used for cable management.

Stippled line 189 in FIG. 7 illustrates an example cable pathway from the space 188 to the lower-rear enclosure 185 and into a rear area (indicated generally by stippled circle 187) of the second portable equipment pedestal 114*a*.

As also shown in FIG. 7, the upper panels 106*a* and 106*b* in this embodiment extend a short distance (e.g. about 4 inches) from the front 103 of the counter 100, but do not extend all the way to the first back wall 124*a*. The vertical panel 182 of the first upper-rear counter portion 130*a* is between the upper panels 106*a* and 106*b* and the first back wall 124*a* with clearance between the upper panels 106*a* and 106*b* and the vertical panel 182.

The second back wall 124*b* (shown in FIG. 5) and the upper-rear counter portion 130*b* (shown in FIG. 1) of the second counter section 104 have structure and arrangement similar to the first back wall 124*a* and the first upper-rear counter portion 130*a* of the first counter section.

The pull-out shelf 172*a* is shown in the retracted position in FIG. 7.

The first counter section 102 of the counter 100 in this embodiment provides a space 199*a* (e.g. about 6 inches deep in this embodiment) behind the first portable equipment pedestal 112*a* (shown in FIG. 4) and the second portable equipment pedestal 114*a*. The second counter section 104 provides a similar space 199*b* (shown in FIG. 8) This space 199*a* and 199*b* may be used for cable management or other equipment storage. The counter 100 includes a spacer block or shelf 198 between the first back wall 124*a* and the first portable equipment pedestal 112*a* (shown in FIG. 4) and the second portable equipment pedestal 114*a* to assist with horizontal alignment/positioning of the portable equipment pedestals 112*a* and 114*a*. The space 199*a* may be utilized for cable management. For example, the space 199*a* may house the power/data cables that connect the first and second equipment pedestals 112*a* and 114*a* to the counter 100. As also shown in FIG. 7, the power/data connection box 190 is positioned at the top of the space 199*a*, which may facilitate connection to the first and second equipment pedestals 112*a* and 114*a*.

The spacer panel 128*a* is also shown in FIG. 7. In this embodiment, the spacer panel 128*a* is over the first portable equipment pedestal 112*a* (shown in FIG. 4) and the second portable equipment pedestal 114*a*, but does not extend substantially into the free space 199*a* behind the portable equipment pedestals 112*a* and 114*a*.

Optional power/data connection port 193*a*, which may include one or more power outlets and data connections, is shown in FIG. 7. The power/data connection port 193*a* is positioned near the rear 195 of the second portable equipment pedestal 114*a* (below the upper shelf 152) in this example (although this position is optional). The power/data connection port 193*a* may provide a terminal for power/data connections to the equipment held in the second portable equipment pedestal 114*a*. Thus, external power and/or data connections may be coupled to the may be provided to the power/data connection port 193*a* to provide power and/or data communication to the first portable equipment pedestal 114*a*. For example, a power outlet 191 on the counter may be connected by a power cable to the power/data connection port 193*a* to power the portable equipment pedestal 114*a*. A data connection to/through the counter 100 and the power/data connection port 193*a* may also be provided.

Figure 8:
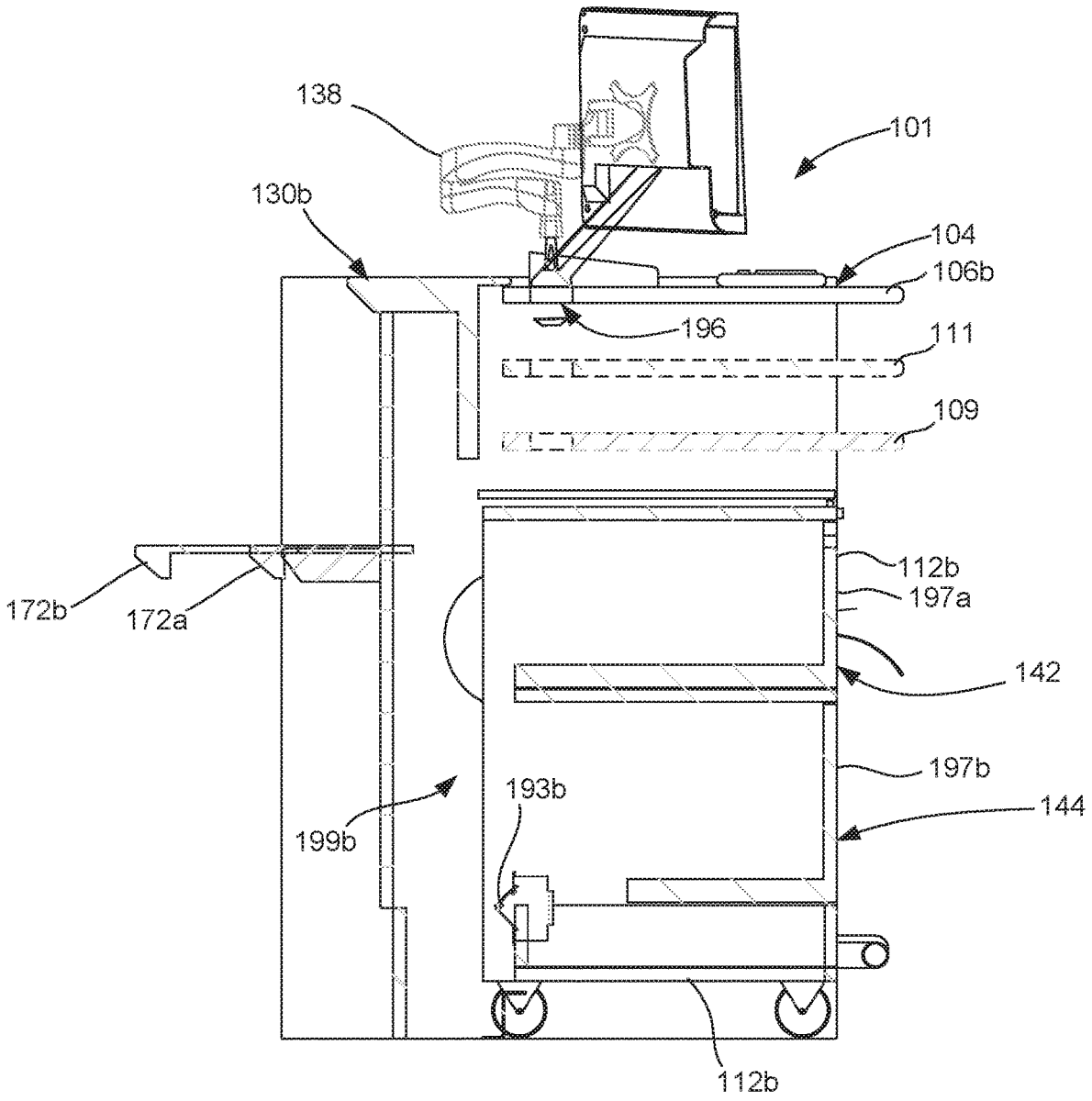
FIG. 8 is a cross sectional view of the modular counter system taken along the line C-C in FIG. 6.

FIG. 8 is a cross sectional view of the modular counter system 101 taken along the line C-C, through the second counter section 104 in FIG. 6. The cross-section of FIG. 8 extends through the first portable equipment pedestal 112*b* of the second counter section 104. The second counter section 104 has a structure similar to the first counter section 102 (FIG. 7) in this example.

Similar to FIG. 7, optional vertical positions 109 and 111 of the upper panel 106*b* of the second counter section 104 are shown for illustrative purposes.

The upper-rear counter portion 130*b* is also visible in FIG. 8, and as shown it has a similar structure and arrangement as the upper-rear counter portion 130*a* of the first counter section 102 (shown in FIGS. 1 and 7). The upper panel 106*b* defines a hole 196 therethrough for receiving and securing the adjustable arm 138. The upper cabinet space 142 of the first equipment pedestal includes an upper drawer 197*a*. The lower cabinet space 144 of the first equipment pedestal includes a lower drawer 197*b*. One pull out shelf 172*b* is shown in the extended position in FIG. 8, while the other pull out shelf 172*a* is shown in the retracted position.

Power/data connection port 193*b*, which may include one or more power outlets and data connections, is shown in FIG. 8. The power/data connection port 193*b* may provide a terminal for power/data connections to the equipment held in the first portable equipment pedestal 112*a*. Thus, external power and/or data connections may coupled to the power/data connection port 193*b* to provide power and/or data communication to the first portable equipment pedestal 112*a*. For example, a power outlet 191 (shown in FIG. 7) may be connected by a power cable to the power/data connection port 193*b* to power the portable equipment pedestal 112*a*.

Figure 9:
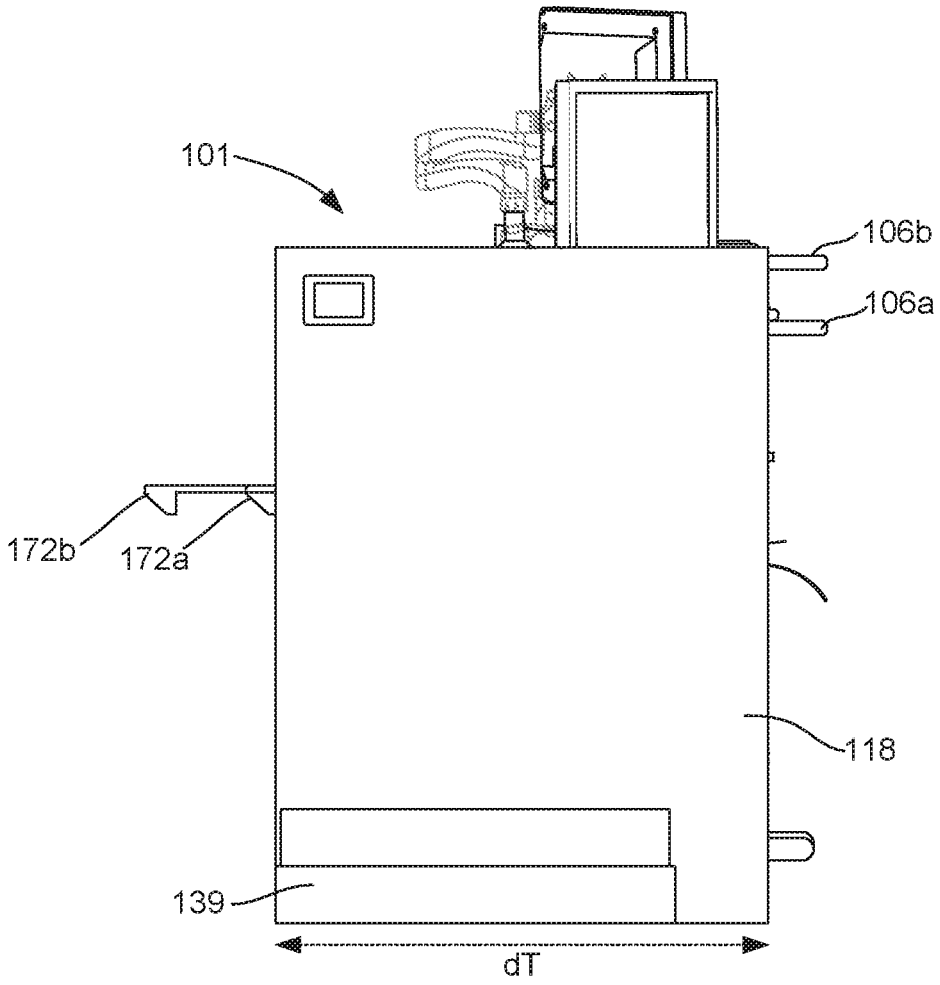
FIG. 9 is a side view of the modular counter system of FIGS. 6 to 8.

FIG. 9 is a side view of the modular counter system 101 of FIGS. 5 to 8. In this view, the first side wall 118 and the weigh scale 139 is visible. As also shown, the upper panels 106*a* and 106*b* extend forward past the first side wall 118 in this example. Pull-out shelves 172*a* and 172*b* are also visible extending rearward beyond the first side wall 118.

Figure 10:
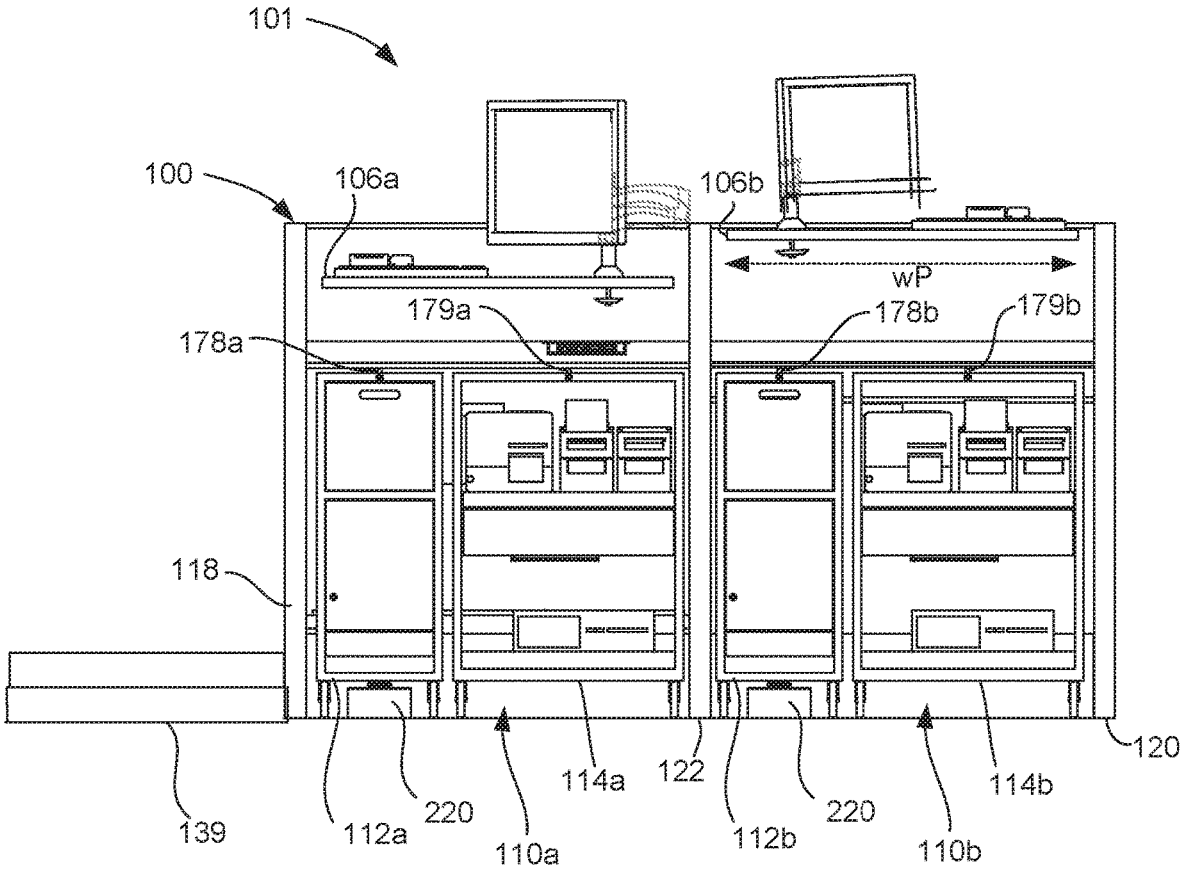
FIG. 10 is a front view of the modular counter system of FIGS. 6 to 9.

FIG. 10 is a front view of the modular counter system 101, including the counter 100 and both sets of first and second portable equipment pedestals 112*a*, 114*a* and 112*b*, 114*b* and the weigh scale 139. In this example, the first and second portable equipment pedestals 112*a*, 114*a* and 112*b*, 114*b* include locks 178*a*, 179*a*, 178*b* and 179*b* respectively to restrict access to equipment stored within the portable equipment pedestals 112*a*, 114*a* and 112*b*, 114*b*. For example, the locks 178*a*, 179*a*, 178*b* and 179*b* may secured drawers and/or doors of the portable equipment pedestals 112*a*, 114*a* and 112*b*, 114*b*.

Figure 11:
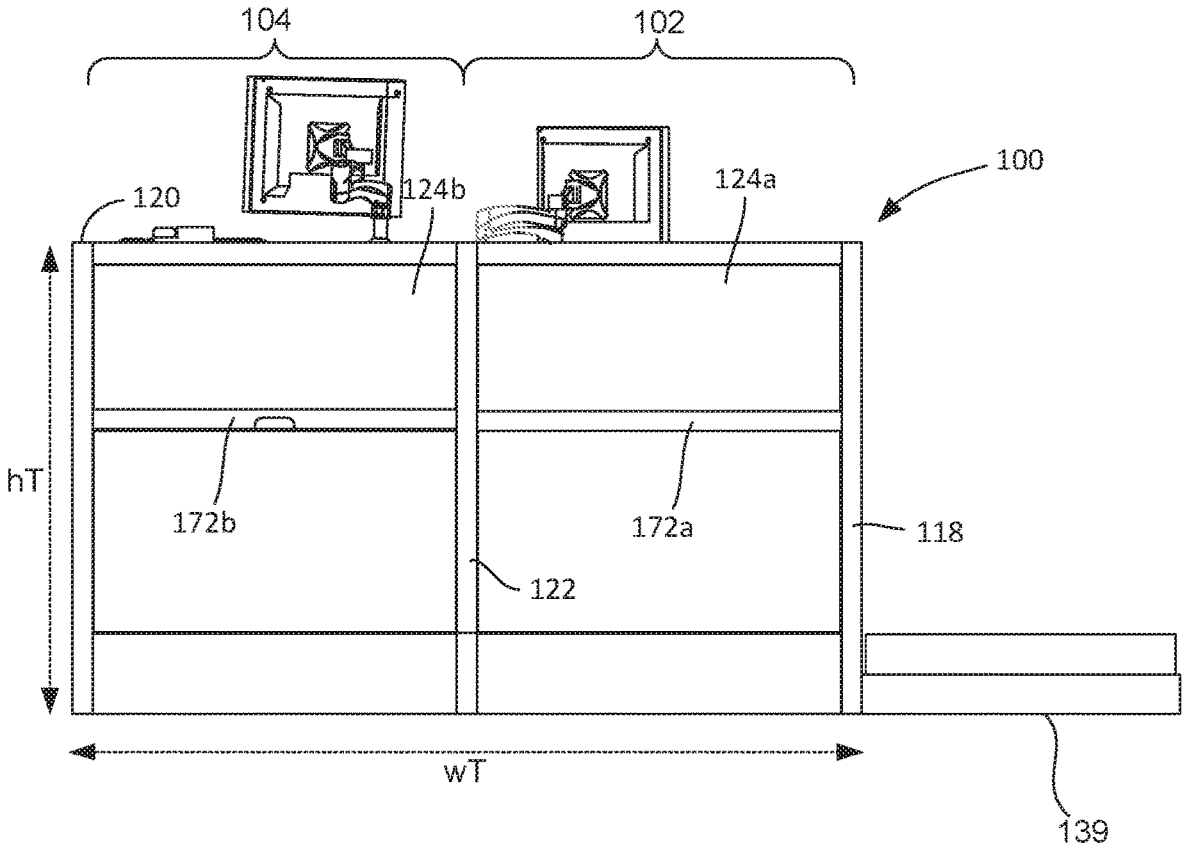
FIG. 11 is a rear view of the modular counter system of FIGS. 6 to 10.

FIG. 11 is a rear view of the counter 100 of the modular counter system 101 of FIGS. 5 to 10. The vertical position of the pull-out shelves 172*a* and 172*b* is shown.

Example dimensions of the various components of the modular counter system 101 will now be described with reference to FIGS. 9 to 11. However, it is to be understood that these dimensions are provided by way of example only, and specific dimensions may vary in other embodiments.

The total width (wT in FIG. 11) of the first and second counter sections 102 and 104 of the counter 100, including the side walls 118 and 120, may be approximately 78 inches. The total height (hT in FIG. 11) of the counter 100 may be approximately 46.5 inches. The total depth of the counter (dT in FIG. 9) may be approximately 34 inches. The width of the individual upper panels 106*a* and 106*b* (wP in FIG. 10) may be approximately 33 inches, leaving approximately 1.5 inches of clearance between the upper panel 106*a* and each the first side wall 118 and the intermediate wall 122 for the first counter section 102, and between the upper panel 106*b* and each of the second side wall 120 and the intermediate wall 122 for the second section 104. Each of the first side wall 118, the second side wall 120 and the intermediate wall 122 may be approximately 2 inches thick. The distance between the first side wall 118 and the intermediate wall 122 may be approximately 36 inches. The distance between the second side wall 120 and the intermediate wall 122 is the same in this example, as is the width of each pull out shelf 172*a* and 172*b*.

The pull-out shelves 172*a* and 172*b* may extend approximately 5 inches from the corresponding back wall 124*a* and 124*b* in the retracted position. In the extended position, the pull-out shelves 172*a* and 172*b* may extend approximately 15 inches from the corresponding back wall 124*a* and 124*b*. The pull-out shelves 172*a* and 172*b* may each be approximately 30.25 inches from the floor, but may also be up to 36 inches from the floor. However, the 30.25 inch height may be a preferable height for using the pull-out shelves 172*a* and 172*b* for writing etc.

The weigh scale 139 may be approximately 31.5 wide by 27.5 deep by 7.75 inches tall in size.

Each of the first portable equipment pedestals 112*a* and 112*b* (FIG. 10) may be approximately 12 inches wide, and each of the second equipment pedestals 114*a* and 114*b* (FIG. 10) may be approximately 21.5 inches wide. Each of the portable equipment pedestals 112*a*, 112*b*, 114*a* and 114*b* may be approximately 32.5 inches high. The equipment pedestal bays 110*a* and 110*b* (FIG. 10) may be sized to provide approximately 1 inch of clearance on either side of each of the portable equipment pedestals 112*a*, 112*b*, 114*a* and 114*b*, and clearance above the pedestals.

As discussed above, the upper panels 106*a* and 106*b* are vertically adjustable. The height of the upper panels 106*a* and 106*b* from a floor surface (not shown) may be adjustable, for example, in the range of approximately 37 inches to 46 inches. The upper panels 106*a* and 106*b* may have a continuous range of possible heights. For example, the upper panels 106*a* and 106*b* may be mounted to a respective vertical lift, such as the vertical lift 242 shown in FIGS. 18 to 22 and described below. In other embodiments, the upper panels 106*a* and 106*b* may have discrete vertical positions available. For example, the upper panels 106*a* and 106*b* may be mounted to a support column having two or more discrete mounting positions. Any suitable method for providing vertical adjustment of the upper panels 106*a* and 106*b* may be used.

The modular counter system 101 described herein may be comprised of various materials, and embodiments are not limited to a particular material makeup. For example, each of the first side wall 118, the second side wall 120 and the intermediate wall 122 may be composed of stainless steel or another metal. Wood or plastic materials may also be used. The first and second back walls may also be made of wood, metal or plastic materials. Likewise, the portable equipment pedestals 112*a*, 112*b*, 114*a* and 114*b* may be made of any suitable material, and embodiments are not limited to any particular construction.

Figure 12:
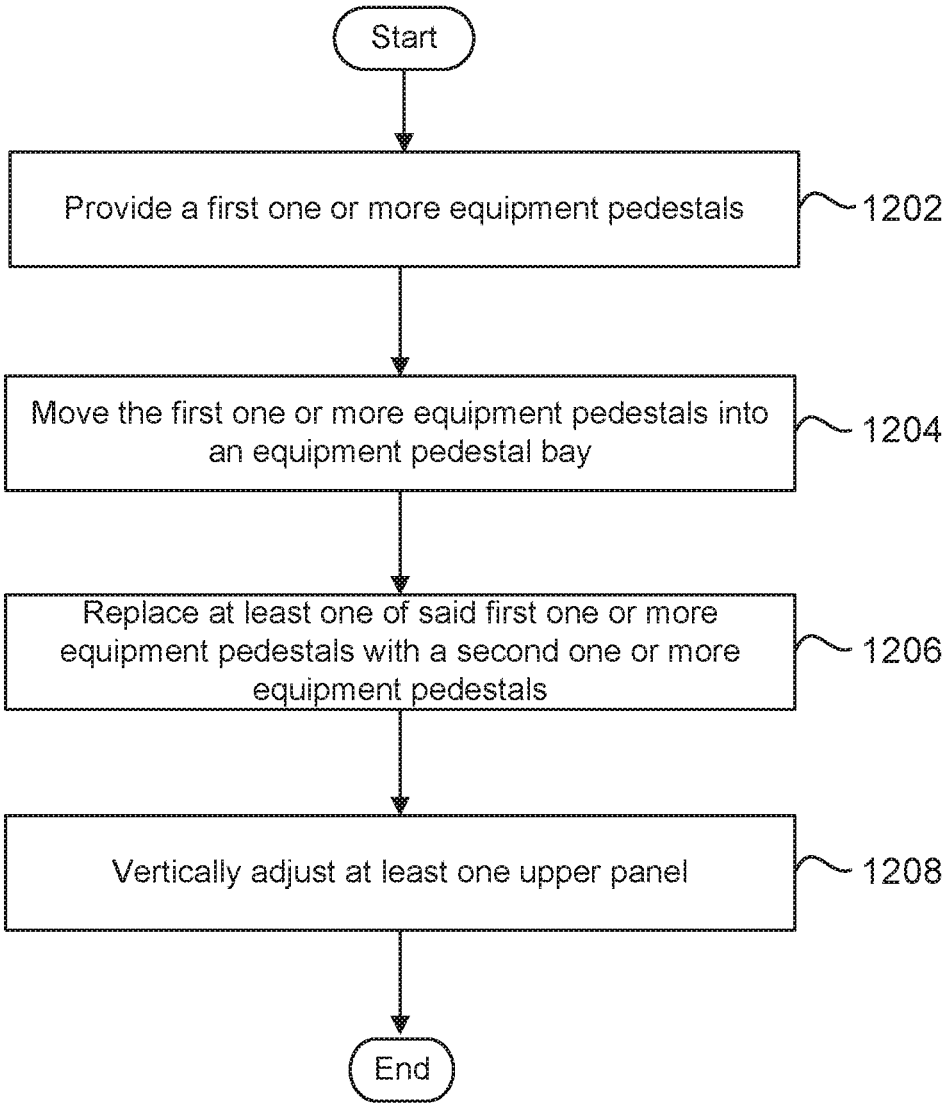
FIG. 12 is a flowchart of a method according to some embodiments.

FIG. 12 is a flowchart of a method for using a modular counter system as described above or below according to some embodiments. The counter system includes a counter having one or more equipment pedestal bays (such as equipment pedestal bays 110*a* and 110*b* of the counter 100 in FIG. 1). The counter may also include one or more vertically adjustable upper panels.

At block 1202, a first one or more equipment pedestals (such as the portable equipment pedestals 112*a*, 112*b*, 114*a* and 114*b* shown in FIGS. 3 to 5) are provided for each equipment pedestal bay. Providing the at least one equipment pedestal may include purchasing, manufacturing, assembling or any other method of obtaining the at least one equipment pedestal. At block 1204, the one or more equipment pedestals are moved into the corresponding equipment pedestal bay(s). Optionally, at block 1206, one or more of the first equipment pedestal(s) are replaced or swapped with one or more second equipment pedestals. For example, the replacement equipment pedestals may different equipment for a different customer service and/or configured equipment for a particular user (e.g. worker) as described above. The method may also include providing the second one or more portable equipment pedestals (e.g. purchasing, manufacturing or assembling, etc.). Optionally, at block 1208 one or more upper panel of the counter is vertically adjusted. For example, the upper panel(s) may be adjusted to a particular height suitable for a particular worker and/or for a particular function or service.

In some embodiments, the counter may include a frame to which cladding and/or panels are attached or mounted. The counter may include only a single counter section (with a single equipment pedestal bay).

Counters of the modular counter system described herein are not limited to the particular counter 100 shown in FIGS. 1 and 2. In some embodiments, the counter may comprise one or more connectable and/or separable counter modules. Each counter module of the system will, thus, essentially form a section of the overall counter (similar to the counter sections 102 and 104 in FIGS. 1 and 2). The counter modules described herein may facilitate simple customization of counter.

Figure 13:
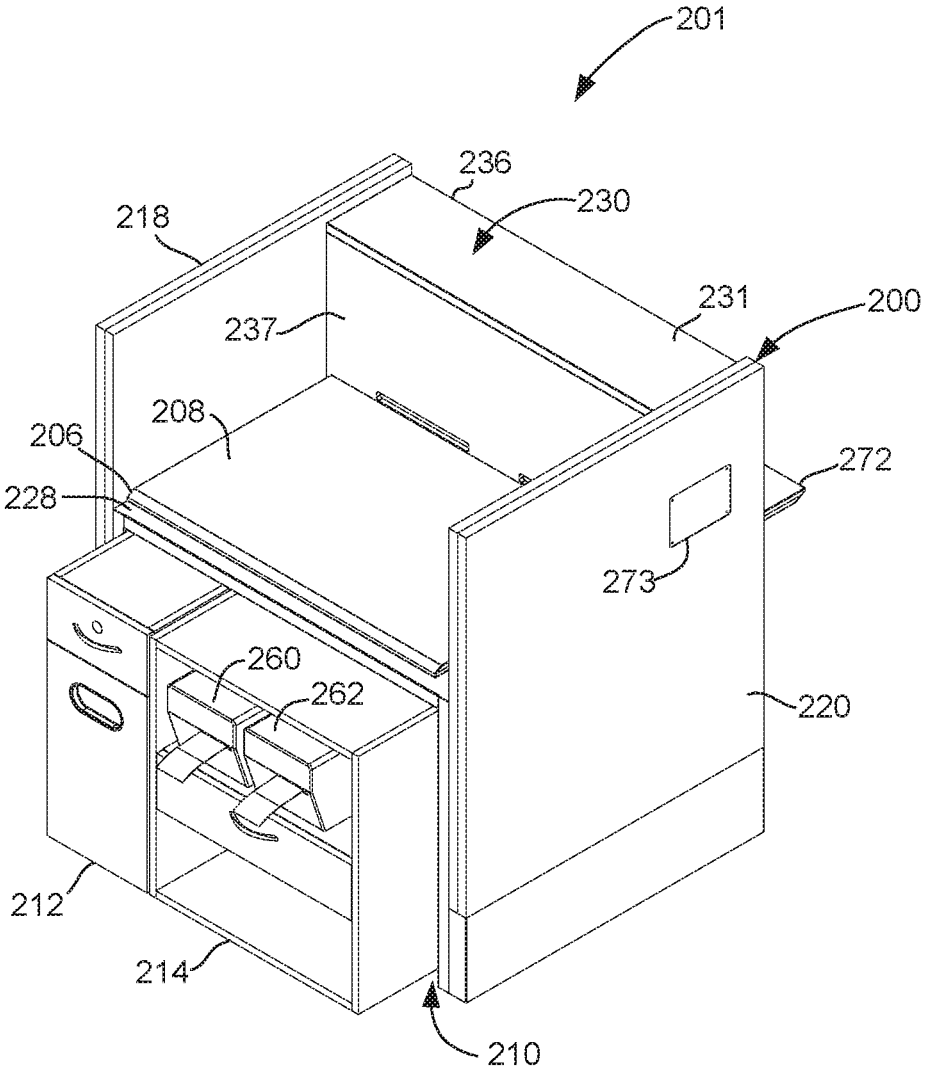
FIG. 13 is a front perspective view of a modular counter system according to another embodiment.

FIG. 13 is a front perspective view of the example modular counter system 201 according to another embodiment. The modular counter system 201 includes counter module 200 and first and second equipment pedestals 212 and 214. The counter module 200 defines an equipment pedestal bay 210. Although the first and second equipment pedestals 212 and 214 are shown partially received within the equipment pedestal bay 210 in FIG. 13, it is to be understood that the first and second equipment pedestals 212 and 214 may be fully received within the equipment pedestal bay 210. One or both equipment pedestals 212 and 214 may be swapped with other equipment pedestals (not shown). The counter module 200 includes left and right side walls 218 and 220, a back wall 224 (shown in FIG. 20) and a vertically adjustable upper panel 206 that provides a work surface 208. The upper panel 206 in this embodiment is mounted to a vertical lift 242 (shown in FIGS. 18 to 22) to provide the vertical movement/adjustment of the upper panel 206.

The counter module 200 also includes a spacer panel 228 below the upper panel. The left and right side walls 218 and 220, the back wall 224 and the spacer panel 228 collectively define the equipment pedestals bay 210.

The counter module 200 also includes an upper-rear portion 230, as well as an ADA compliant pull-out shelf 272, similar to the counter 100 shown in FIGS. 1 and 2. The upper-rear portion 230 of the counter module 200 includes a top panel 236 providing the secondary work surface 231, a front cover 237 and a rear cover 238 (shown in FIGS. 20 and 21).

Display 273 is also included, which may function as a weigh scale output if the counter is connected to a weigh scale (such as weigh scale 139 in FIG. 1).

The first and second portable equipment pedestals 212 and 214 are structurally similar to the portable equipment pedestals 112*a* and 114*a* shown in FIGS. 2 and 3 and described above. In this example, the second portable equipment pedestal 214 is shown with baggage and/or ticket printers 260 and 262. However, the equipment carried by the portable equipment pedestals 212 and 214 may vary. Similarly, the size, shape, and storage configuration of the portable equipment pedestals may vary.

Figure 14:
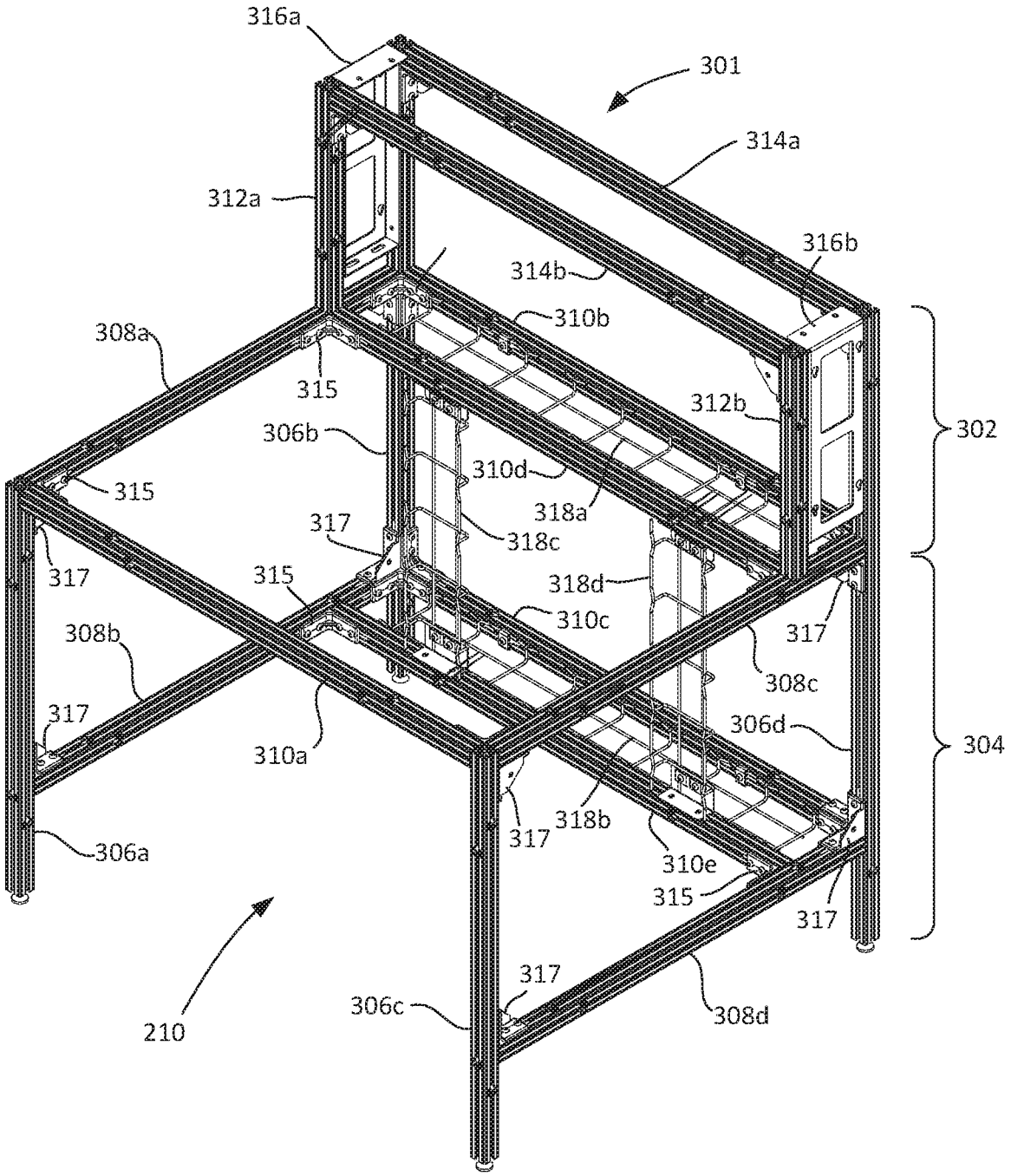
FIG. 14 is a perspective view of a frame for a counter module of the modular counter system of FIG. 13, according to yet another embodiment.
Figure 15:
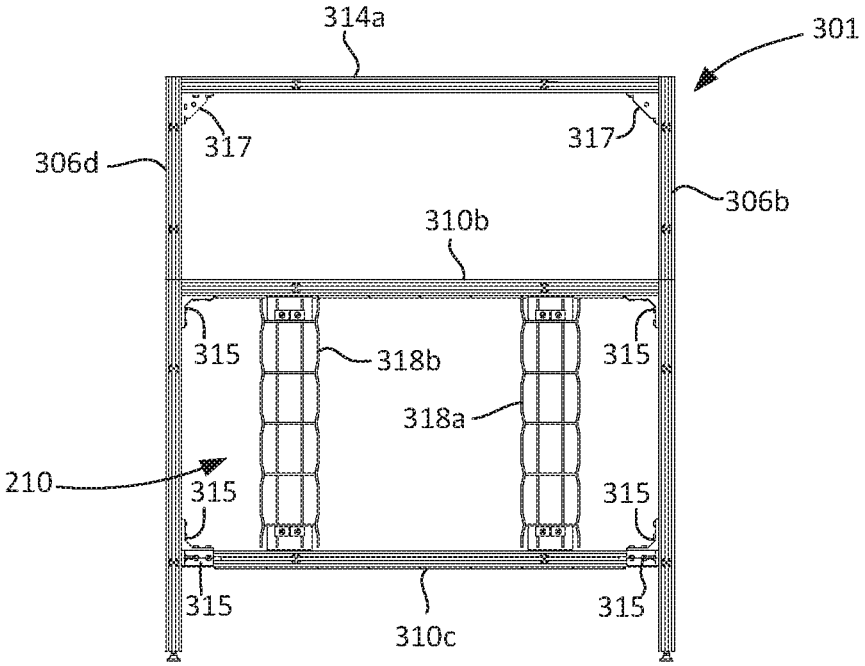
FIG. 15 is a front view of the frame of FIG. 14.
Figure 16:
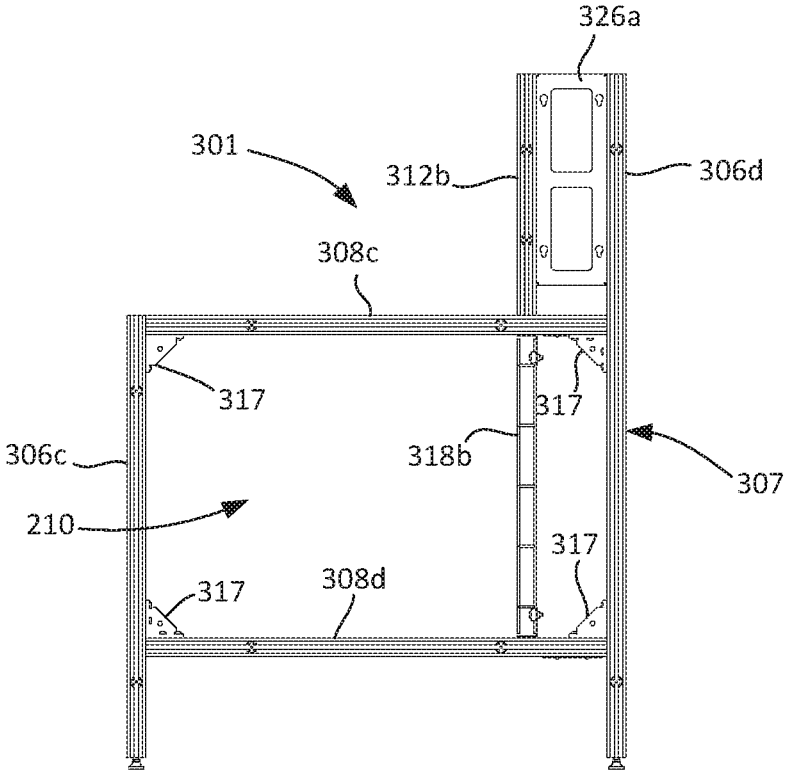
FIG. 16 is a right-side view of the frame of FIGS. 14 and 15.

FIG. 14 is a perspective view of the frame 301 for the counter module 200 of FIG. 13 according to some embodiments. FIG. 15 is a front view of the frame 301 of FIG. 14. FIG. 16 is a right-side view of the frame 301 of FIGS. 14 and 15.

Referring to FIGS. 14 to 16, the counter frame 301 generally includes an upper frame portion 302 and a lower frame portion 304. The lower frame portion 304 comprises: floor engaging front and rear left-side vertical beams 306*a* and 306*b*; floor engaging front and rear right-side vertical beams 306*c* and 306*d*; upper and lower left-side horizontal beams 308*a* and 308*b* interconnecting the left-side vertical beams 306*a* and 306*b*; upper and lower right-side horizontal beams 308*c* and 308*d* interconnecting the right-side vertical beams 306*c* and 306*d*; upper front horizontal beam 310*a* interconnecting the front left-side vertical beam 306*a* and the front right-side vertical beam 306*c*; upper and lower rear horizontal beams 310*b* and 310*c* interconnecting the rear left-side vertical beam 306*b* and the rear right-side vertical beam 306*d*; upper intermediate horizontal beam 310*d* interconnecting the upper left-side and upper right-side horizontal beams 308*a* and 308*c*; and lower intermediate horizontal beam 310*e* interconnecting the lower left-side and lower right-side horizontal beams 308*b* and 308*d*.

The rear left-side and rear right-side vertical beams 306*b* and 306*d* extend higher than the front left-side and front right-side vertical beams 306*a* and 306*c*, forming part of the upper frame portion 302 as well. The upper frame portion 302 further includes left and right vertical beams 312*a* and 312*b* that are spaced forward from the rear left-side and rear right-side vertical beams 306*b* and 306*d*, and which extend upward from the upper left-side and upper right side horizontal beams 308*a* and 308*c* respectively. The upper frame portion 302 further includes: a rear top horizontal beam 314*a* that interconnects the rear left-side and rear right-side vertical beams 306*b* and 306*d*; and a front top horizontal beam 314*b* that interconnects the left and right vertical beams 312*a* and 312*b*. Finally, the upper frame portion 302 further includes: a left-side frame panel 316*a* connected between the left vertical beam 312*a* and the rear left-side vertical beam 306*b*; and a right-side frame panel 316*b* connected between the right vertical beam 312*b* and the rear right-side vertical beam 306*d*.

The various beams 306*a* to 306*d*, 308*a* to 308*d*, 310*a* to 310*e*, 312*a*, 312*b*, 314*a* and 314*b* in this example are all extrusions (such as aluminum or other metal extrusions), although other structural elements and/or materials may be used to construct a frame in other embodiments. The beams 306*a* to 306*d*, 308*a* to 308*d*, 310*a* to 310*e*, 312*a*, 312*b*, 314*a* and 314*b* are interconnected as shown using a series of L-shape brackets 315 and 317, although any other suitable method for connecting beams may be used.

Optional cable management features are also shown in FIGS. 14 to 16. Specifically, an upper cable management wire tray 318*a* (FIG. 13) is attached between the upper intermediate horizontal beam 310*d* and the upper rear horizontal beam 310*b*. A lower cable management wire tray 318*b* (FIG. 13) is attached between the lower intermediate horizontal beam 310*e* and the lower rear horizontal beam 310*c*. Spaced apart vertical cable management wire trays 318*c* and 318*d* are also shown. The vertical wire trays 318*c* and 318*d* may provide a cable pathway from the upper frame portion 302 into the lower frame portion 304, for example.

As seen in FIGS. 14 to 16, the frame 301 provides the equipment pedestal bay 210.

Figure 17:
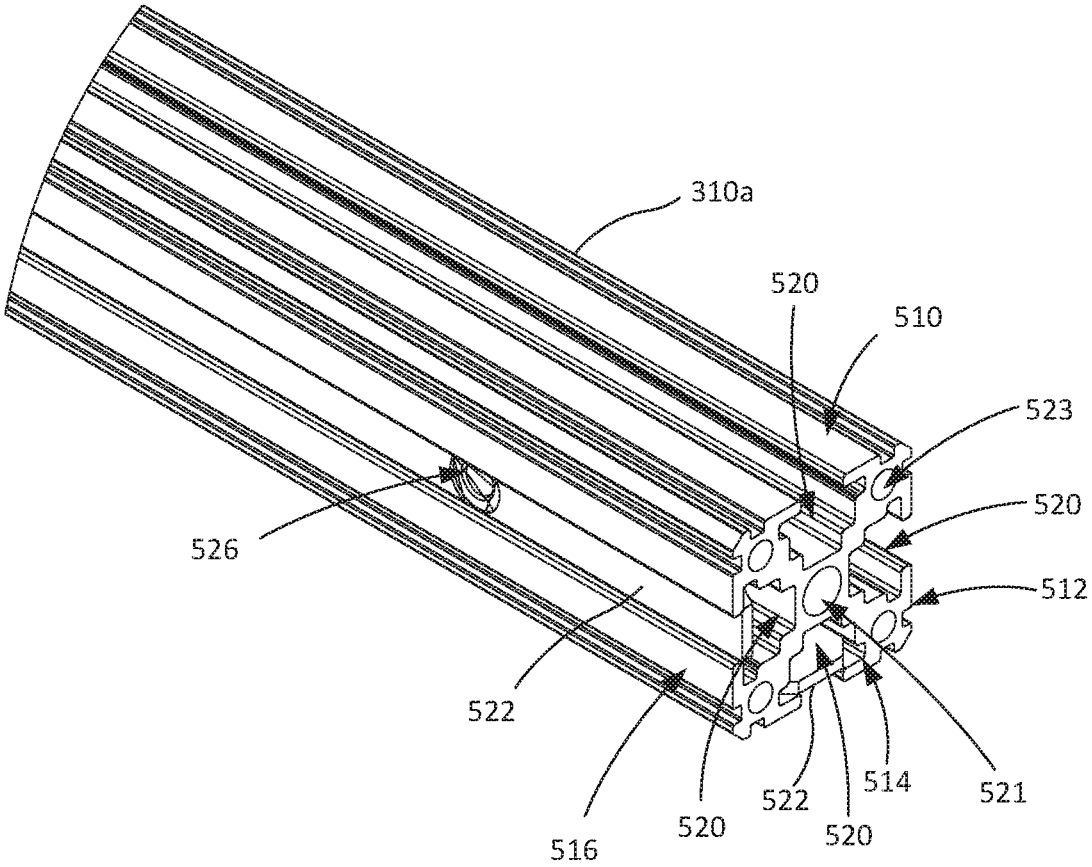
FIG. 17 is an enlarged partial perspective view of a beam of the frame of FIGS. 14 to 16.

FIG. 17 is an enlarged partial view of the upper front horizontal beam 310*a* in FIG. 13. The remaining beams 306*a* to 306*d*, 308*a* to 308*d*, 310*b* to 310*e*, 312*a*, 312*b*, 314*a* and 314*b* have a similar structure, although that is not required in other embodiments. As shown, the beam 310*a* has four elongate sides 510, 512, 514 and 516, each defining a respective port 520 along the length thereof. The ports 520 are in the form of elongate slots for attachment or mounting of various components and equipment. The ports 520 have a profile shaped for receiving bolts, screws or other fastening hardware. Optional center hole 521 extends lengthwise along the center axis of the front horizontal beam 310*a*. Additional optional holes 523 extend lengthwise through the front horizontal beam 310*a*. The holes 521 and 523 may also reduce the material required and weight of the extrusion while still providing sufficient structural stability and support.

Example attachment strips 522 are shown within two of the ports 520 in FIG. 15. The attachments strips include self-clinching nuts 526 at various positions as desired for receiving bolts or other fastening hardware. For example, the various L-shaped brackets 315 and 317 in FIGS. 14 to 16 receive bolts that attach to corresponding self-clinching nuts in attachments strips (not shown) within the corresponding beams 306*a* to 306*d*, 308*a* to 308*d*, 310*a* to 310*e*, 312*a*, 312*b*, 314*a* and 314*b*. Such attachment strips may also be used in ports of one or more of the beams 306*a* to 306*d*, 308*a* to 308*d*, 310*a* to 310*e*, 312*a*, 312*b*, 314*a* and 314*b* for mounting equipment to the frame 301. Embodiments are not limited to this connection method, and any suitable method for interconnecting the beams 306*a* to 306*d*, 308*a* to 308*d*, 310*b* to 310*e*, 312*a*, 312*b*, 314*a* and 314*b* or other frame elements may be used.

The left side wall 218 in FIG. 13 is secured to and partially covers beams 306*a*, 306*b*, 308*a*, 308*b* and 312*a* shown in FIG. 14. The right side wall 220 is similarly is secured to beams 306*c*, 306*d*, 308*c*, 308*d* and 312*b* of FIG. 14. The back wall 224 (visible in FIGS. 20 and 21) is secured to beams 306*b*, 306*d*, 310*b*, 310*c* and 314*a* in FIG. 14. The top panel 236, the front cover 237 and the rear cover 238 (shown in FIG. 18) of the upper-rear portion 230 in FIG. 13 are likewise secured to the upper portion 302 of the frame 301 in FIG. 14. The left and right side walls 218 and 220 and the back wall 224 may comprise metal (e.g. sheet metal), wood or any other suitable material.

Figure 18:
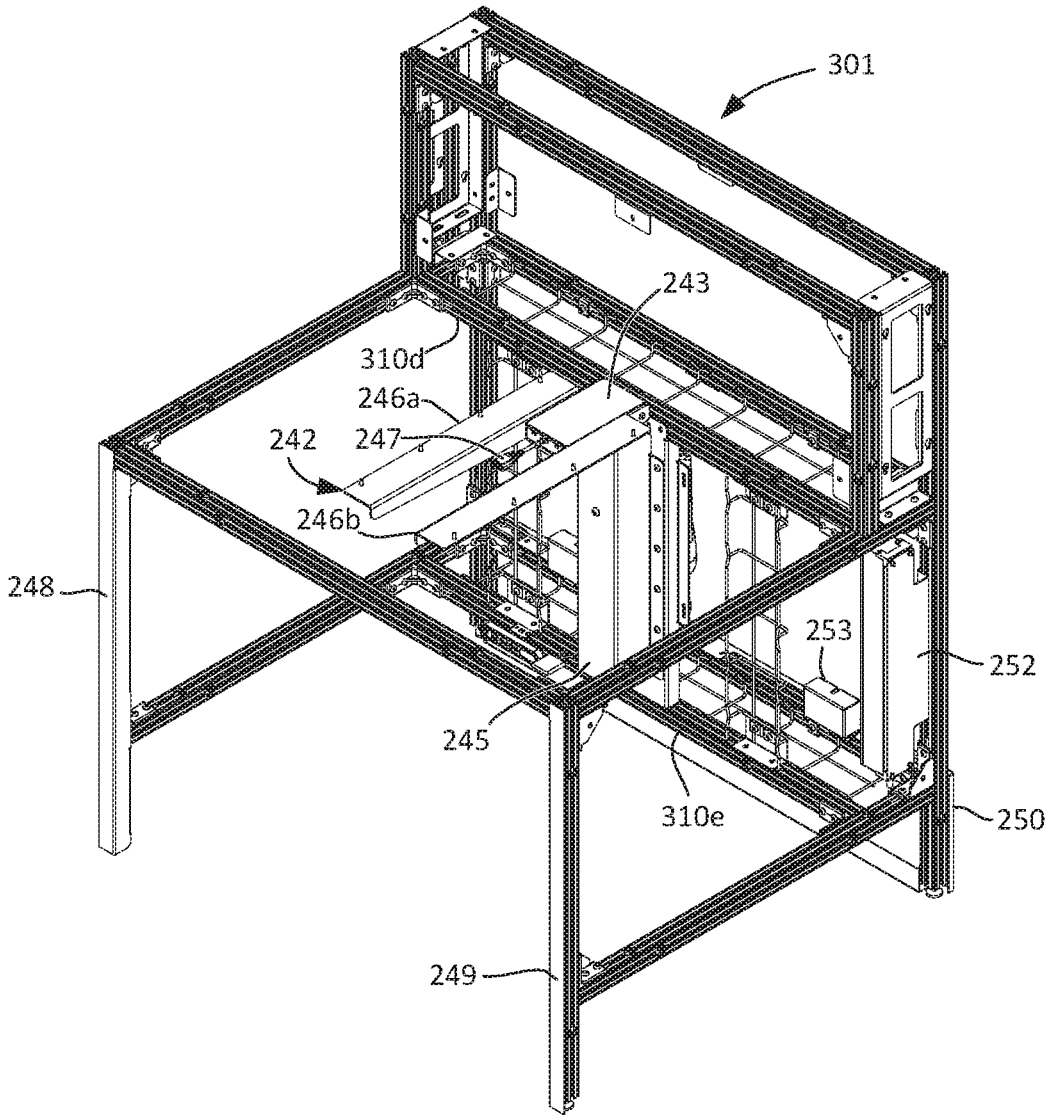
FIG. 18 is a front perspective view of the frame of FIGS. 14 to 16 with a vertical lift mounted to the frame.

FIG. 18 is a front perspective view of the frame 301 of FIGS. 14 to 16 with the vertical lift 242 installed. The vertical lift 242 comprises a driver 243 mounted to a vertically telescoping arm or column (not visible) that is partially contained within a housing 245. The housing 245 is mounted to the upper and lower intermediate horizontal beams 310*d* and 310*e* of the frame 301. Support arms 246*a* and 246*b* are mounted to the driver 243. The upper panel 206 in FIG. 13 is secured on the support arms 246*a* and 246*b*. The driver 243 controls the vertical movement and position of the vertical lift 242, thereby adjusting the vertical position of the upper panel 206 (including the work surface 208 shown in FIG. 13). The vertical lift 242 includes a connector 247 that accepts input to control the driver 243. The driver 243 may be operably connected via the connector 247 to any suitable computer or other input device to allow a user to control the height of the upper panel 206.

Optional front cladding 248 and 249 and rear cladding 250 are attached to the frame 301 as shown. Additional cladding to cover the frame 301 may also be used. Example optional boxes 252 and 253 for storage equipment (e.g. power outlets, etc.) are also shown mounted to the frame 301 in FIG. 18. The cladding 248, 249 and 250 may be sheet metal, for example, although embodiments are not limited to any particular type of cladding.

Figure 19:
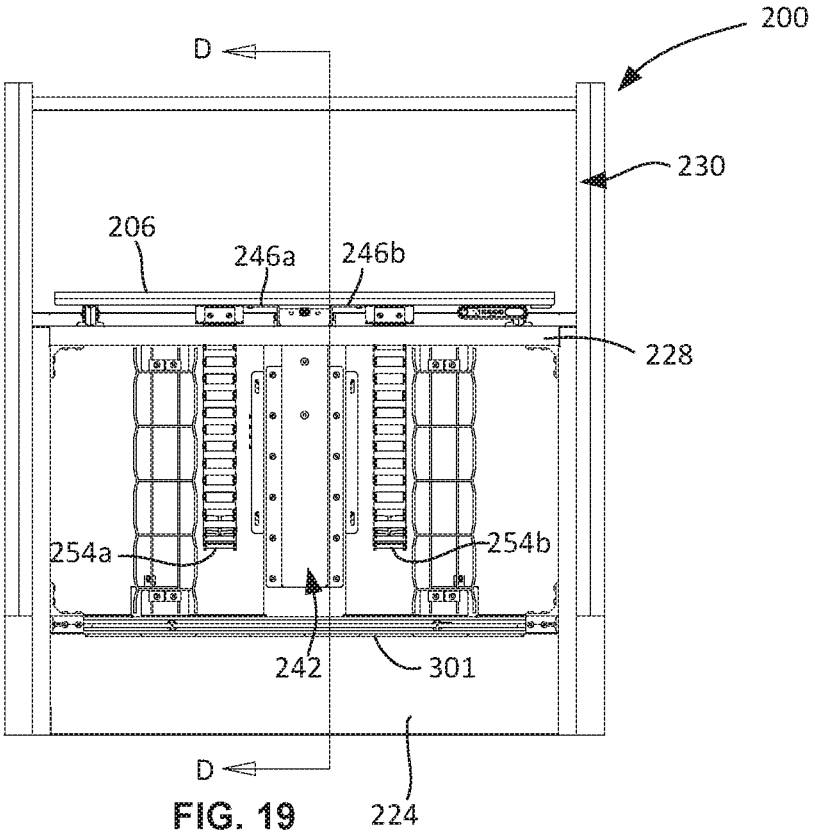
FIG. 19 is a front view of the counter module of the modular counter system of FIG. 13.

FIG. 19 is a front view of the counter module 200 of FIG. 13, but with the first and second portable equipment pedestals 212 and 214 (shown in FIG. 13) removed. The vertical lift 242 is visible, with the upper panel 206 mounted on the first and second support arms 246*a* and 246*b*. Also shown is the spacer panel 228, which positioned under the support arms 246*a* and 246*b* and secured to the upper front horizontal beam 310*a*, the upper left-side horizontal beam 308*a*, and the upper right-side horizontal beam 308*c* (shown in FIG. 13) of the frame 301.

The counter module 200 further includes optional cable guiding chains 254*a* and 254*b*. The cable guiding chains 254*a* and 254*b* extend from an underside of the upper panel 206, down into the from the vertically adjustable upper panel 206 to the base of the upper-rear portion 230. Cladding (such as strips or panels) may cover other portions of the frame 301.

Figure 20:
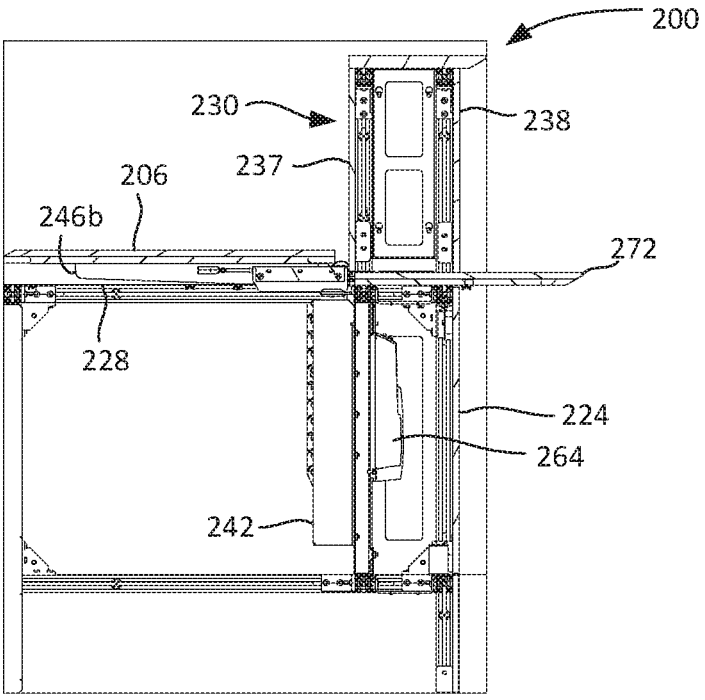
FIG. 20 is a side cross-sectional view of the counter module taken along the line D-D in FIG. 19.
Figure 21:
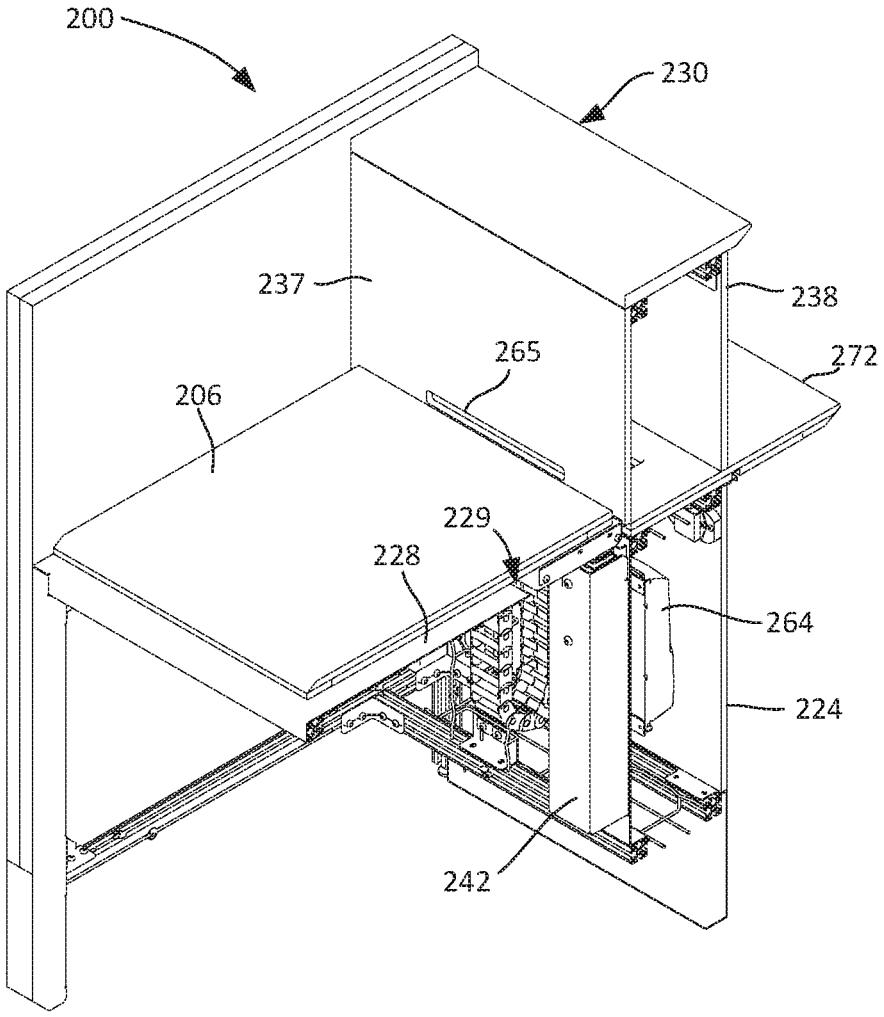
FIG. 21 is a front perspective cross-sectional view of the counter module taken along the line D-D in FIG. 19.

FIG. 20 is a side cross section view of the counter module 200 of FIG. 16 taken along the line D-D in FIG. 19. FIG. 21 is a cross-sectional perspective view of the counter module 200 of FIG. 19, with the cross-section taken along the line D-D in FIG. 16. The rear cover 238 of the upper-rear portion 230 is visible in these figures. The pull-out shelf 272 is also shown in FIGS. 20 and 21. The spacer panel 228 below defines a recess 229 through which the vertical lift 242 extends, such that the first support arm 246*a* (FIG. 18) and second support arm (FIGS. 18 and 20) are above the spacer panel 228 to support the upper panel 206.

FIGS. 20 and 21 also show an optional equipment or technology housing 264 that may store computer hardware or other equipment. Various equipment or hardware may also be mounted to or within the counter module 200 at various locations (e.g. using mounting hardware). The front cover 237 of the upper-rear portion 230 defines an elongated hole 265 (shown in FIG. 21) providing passage for cables to the interior of the upper-rear portion 230. Other access means may also be included (such as removable panels, doors, etc).

As discussed above, multiple counter modules (possibly including the counter module 200 in FIGS. 13 and 19 to 21) may be positioned adjacent to each other to form a counter with multiple equipment pedestal bays. Each counter module may include its own separate pair of side walls (such as side walls 218 and 220 in FIG. 13). Alternatively, two adjacent counter modules may share a side wall therebetween.

Figure 22:
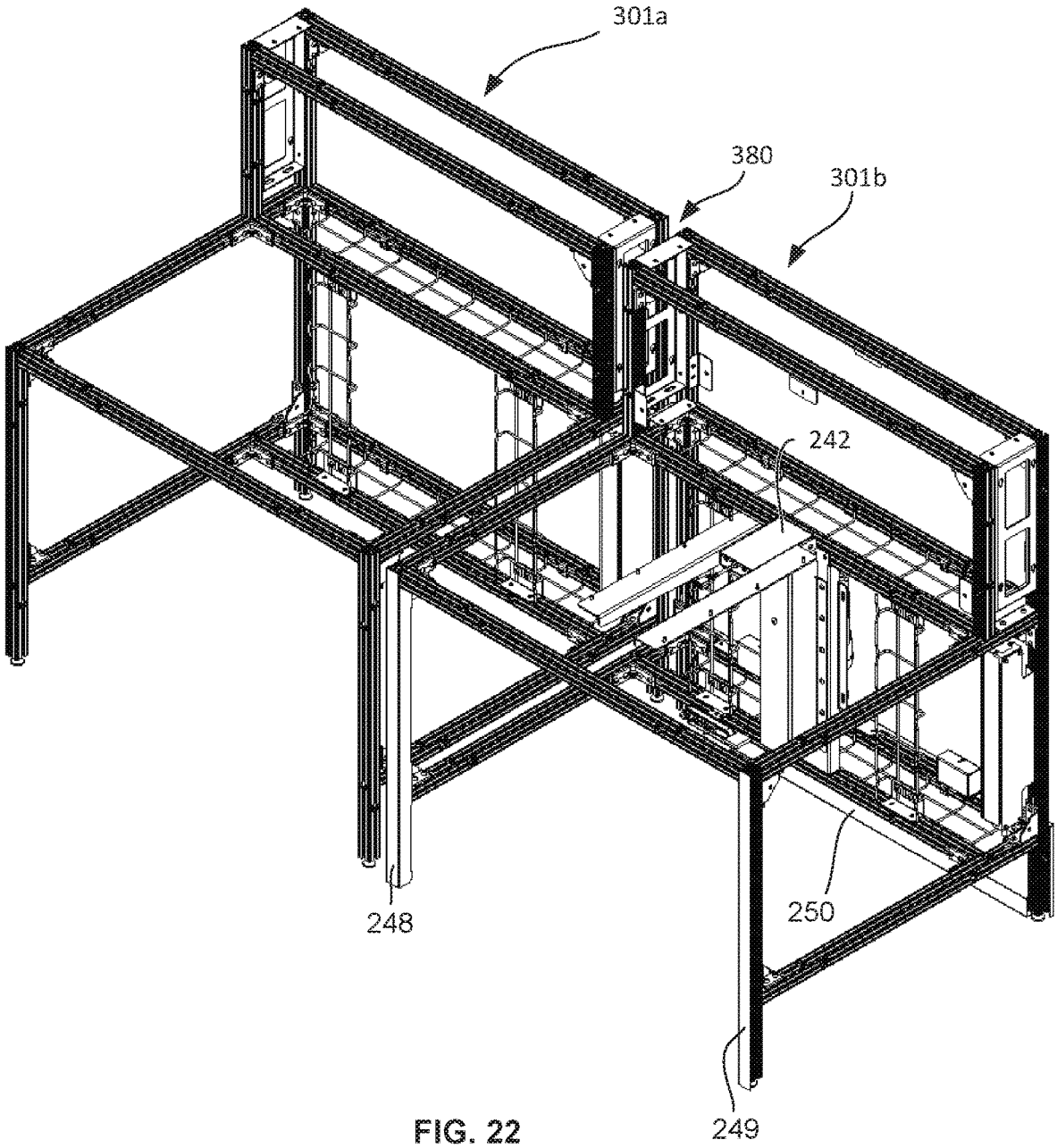
FIG. 22 is a front perspective view of first and second frames for a modular counter system according to another embodiment.
Figure 23:
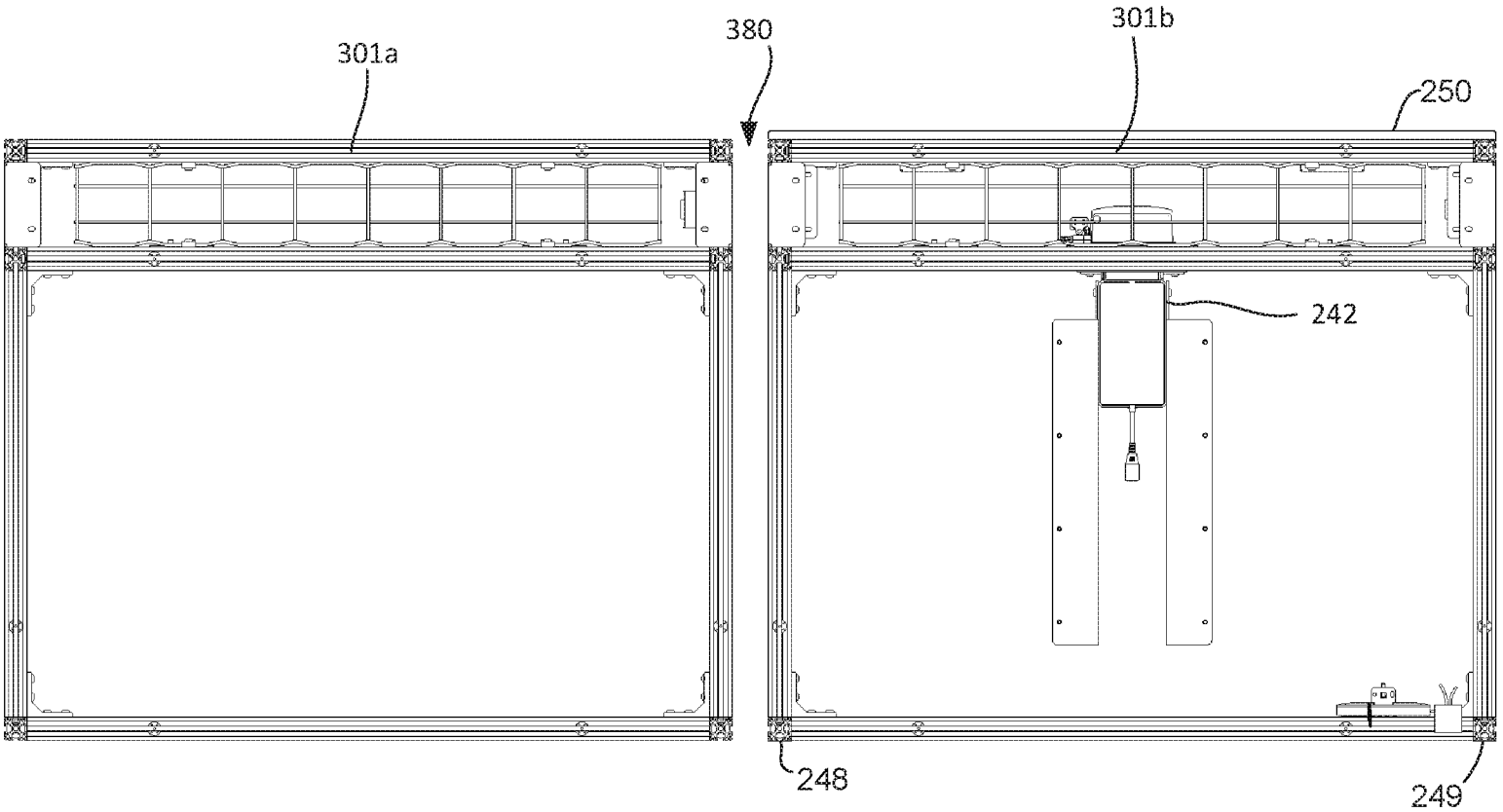
FIG. 23 is a top view of the first and second frames of FIG. 22.
Figure 24:
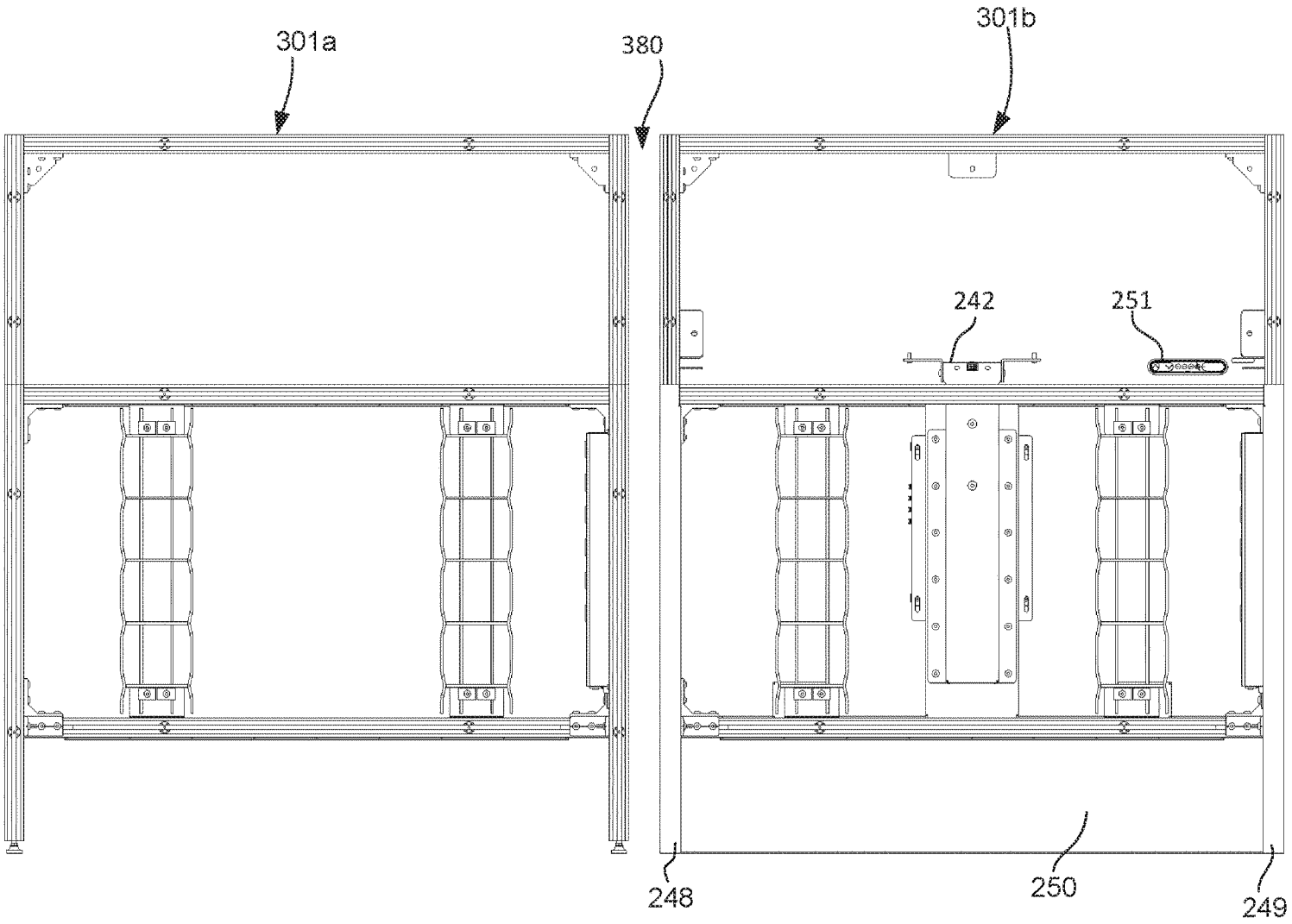
FIG. 24 is a front view of the first and second frames of FIG. 23.

FIG. 22 is a perspective view of first and second frames 301*a* and 301*b* for a multiple module or section counter embodiment. FIG. 23 is a top view of the first and second frames 301*a* and 301*b* of FIG. 22. FIG. 24 is a front view of the first and second frames 301*a* and 301*b* of FIG. 22.

Referring to FIGS. 22 to 24, each frame 301*a* and 301*b* is structurally equivalent to the frame 301 in FIGS. 14 to 16. A vertical lift 242 is shown attached to the second frame 301*b*. An equivalent or different type of vertical actuator may be used with the first frame 301*a* to provide vertical adjustment functionality for an upper panel having a work surface. The cladding 248, 249, 250 is also shown attached to the second frame 301*b*, and similar cladding may be attached to the first frame 301*a*.

The first and second frames 301*a* and 301*b* are spaced apart to leave space 380 to fit a wall therebetween. For example, the right side wall 220 in FIG. 13 could be positioned in the space 380 and attached to both frames 301*a* and 301*b*.

FIG. 24 also shows example electronic switch 251 that is operably connected to the lift 242 and accepts user input to control the lift 242 (i.e. to raise and/or lower the upper panel 206 in FIG. 13).

Figure 25:
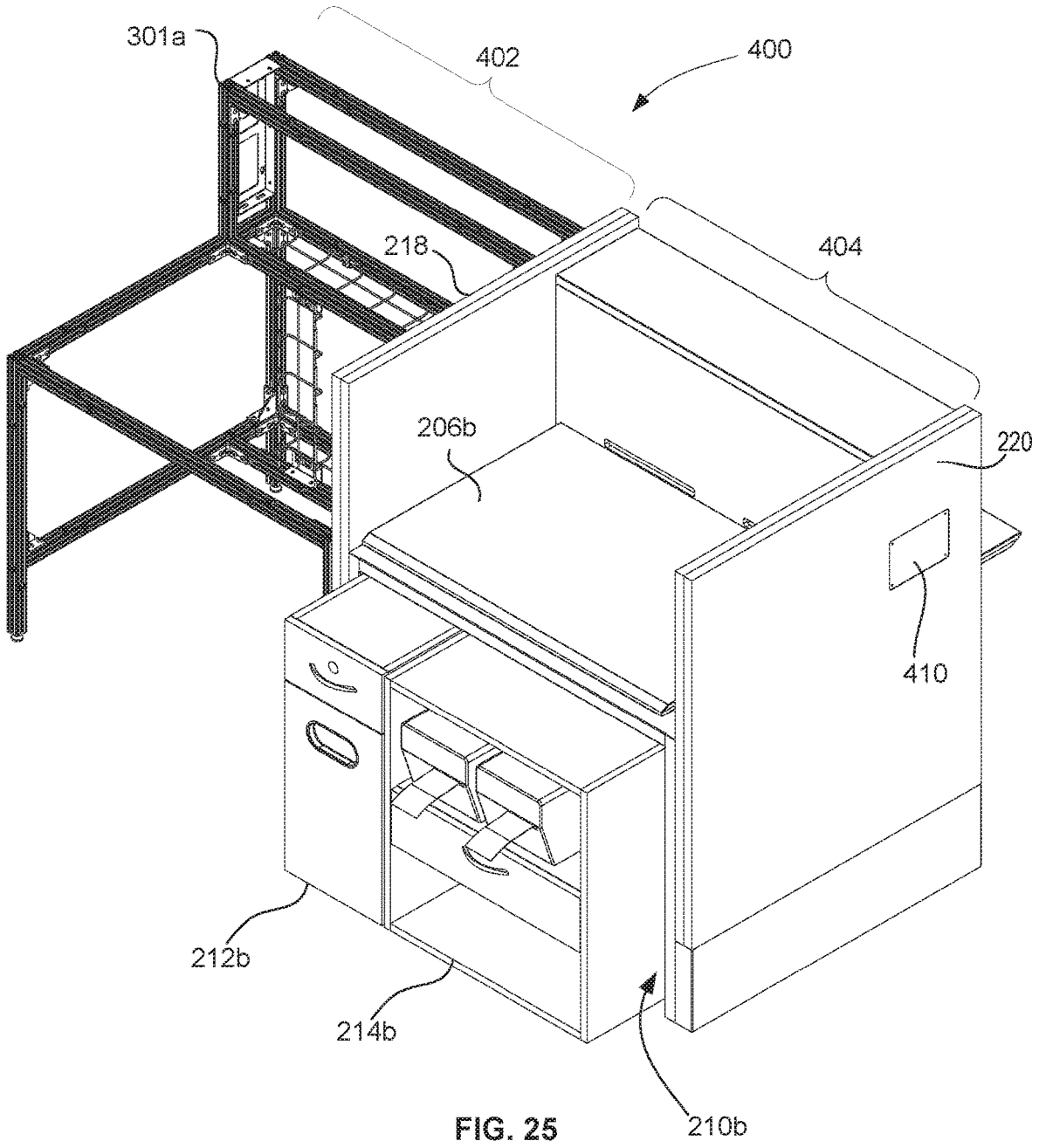
FIG. 25 is a front perspective view of a partially assembled modular counter system including the first and second frames of FIGS. 22 to 24, according to yet another embodiment.
Figure 28:
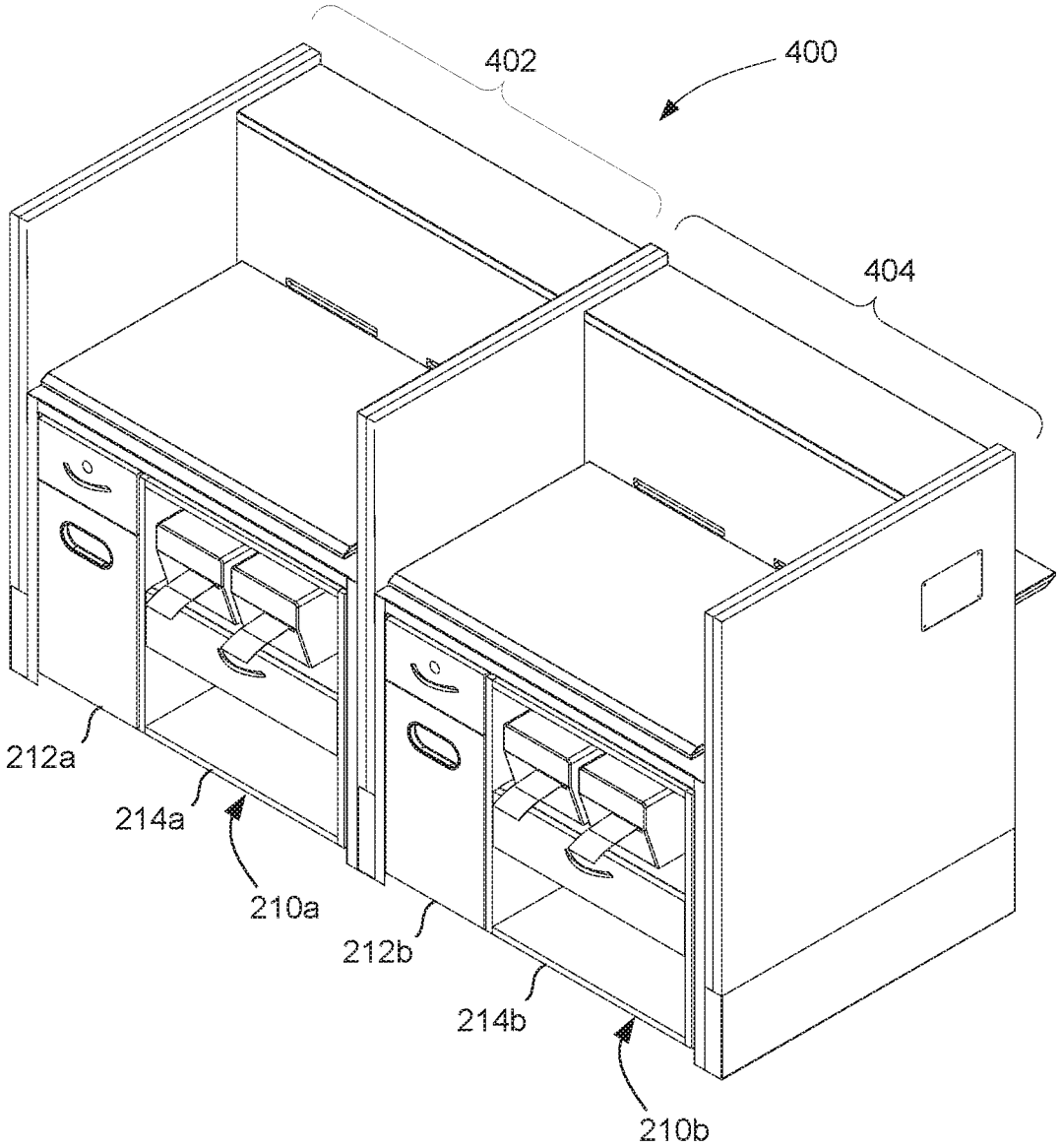
FIG. 28 is a front perspective view of the modular counter system of FIGS. 25 to 27, as assembled.

FIG. 25 is a perspective view of a partially assembled modular counter system 400 that includes the first and second frames 301*a* and 301*b*. The modular counter system 400 includes a first counter section 402 or module and a second counter section 404 or module. The first counter section 402 is not yet fully assembled in FIG. 25, and only the frame 301*a* of the first counter section 402 is shown. The fully assembled first counter section is shown in FIG. 28. The second counter section 404 is fully assembled (including the frame 301*b* in FIGS. 22 to 24) and has a structure similar to the counter module 200 in FIG. 13. More specifically, the second counter section 404 includes a vertically adjustable upper panel 206*b* as well as first and second portable equipment pedestals 212*b* and 214*b* receivable within an equipment pedestal bay 210*b*.

An integrated weigh scale read-out display 410 is shown on side wall 220 of the second counter section 404. The integrated weigh scale read-out display 410 may be connected to a weigh scale (not shown), for example.

The first counter section 402, when fully assembled, is similar to the second counter section 404 in this example. However, the first counter section 402 and the second counter section 404 share wall 218 shown in FIG. 25. That is, wall 218 forms a side wall for each of the counter sections 402 and 404 in this example. Each section 402 and 404 (or module) of the modular counter system 400 may vary in size. For example, different counter sections/modules may have different widths. The structure of the frames 301*a* and 301*b* may vary accordingly.

In some embodiments, adjacent counter sections may not have the same shape, size or configuration. For example, equipment in the two counter sections 402 and 404 may vary. As discussed above, the size, shape, configuration and equipment stored within counter sections of the counter system described herein may vary.

Figure 26:
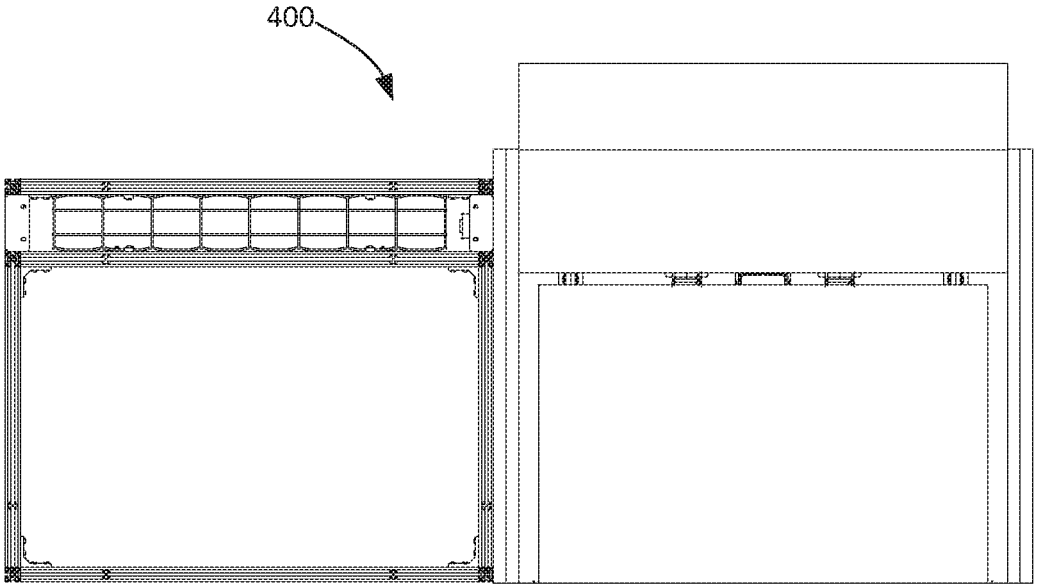
FIG. 26 is a top view of the partially assembled modular counter system of FIG. 25.

FIG. 26 is a top view of the partially assembled modular counter system 400 of FIG. 25.

Figure 27:
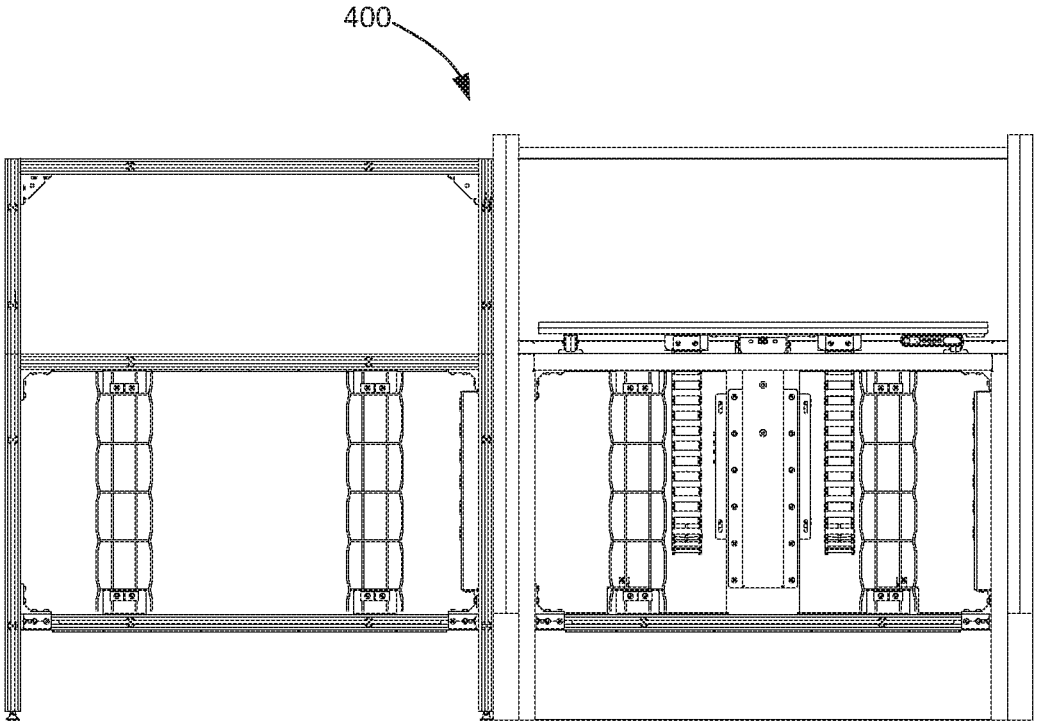
FIG. 27 is a front view of the partially assembled modular counter system of FIGS. 25 and 26.

FIG. 27 is a front view of the partially assembled modular counter system 400 of FIGS. 25 and 26.

FIG. 28 is a front perspective view of the modular counter system 400 of FIGS. 25 to 27. In FIG. 28, the first counter section 402 is assembled and first and second portable equipment pedestals 212*a* and 214*a* are shown received within an equipment pedestal bay 210*a*. One or both of the first and second portable equipment pedestals 212*a* and 214*a* of the first counter section 402, and/or one or both of the first and second portable equipment pedestals 212*b* and 214*b* of the second counter section 404 may be removed or swapped with one or more other portable equipment pedestals. Thus, the modular counter system 400 may be customized for different users and/or different customer services.

The portable equipment pedestals described herein may each include a respective releasable locking mechanism for holding the portable equipment pedestal in position in the respective equipment pedestal bay.

What has been described is merely illustrative of the application of the principles of the disclosure. Other arrangements and methods can be implemented by those skilled in the art without departing from the scope of the present disclosure.

The invention claimed is:

1. A modular counter system comprising:

a counter comprising at least one counter section, each said counter section comprising:

a respective front for facing a first user;

a respective back for facing a second user;

a respective upper panel comprising a respective work surface, said upper panel being vertically adjustable;

a respective equipment pedestal bay, below the upper panel, for receiving one or more respective portable equipment pedestals therein the equipment pedestal bay being open at the front of the counter; and a respective shelf selectively extendable from the back of the counter at a vertical position lower than a vertical position of the upper panel.

2. The modular counter system of claim 1, wherein each said counter section comprises: a first side wall; a second side wall opposite to the first side wall; and a back wall extending between the first and second side walls.

3. The modular counter system of claim 2, wherein the at least one counter section comprises first and second adjacent counter sections, the second side wall of the first counter section being the first side wall of the second counter section.

4. The modular counter system of claim 1, further comprising, for each said counter section, a respective spacer panel below the upper panel, wherein the spacer panel, first and second side walls, and a back wall of the counter section collectively define the respective equipment pedestal bay.

5. The modular counter system of claim 4, wherein the counter is configured to rest on a floor, and for each said counter section, the respective equipment pedestal bay extends from the spacer panel to the floor.

6. The modular counter system of claim 1, further comprising, for each said counter section, the one or more respective portable equipment pedestals, wherein each said portable equipment pedestal is receivable within the corresponding equipment pedestal bay.

7. The modular counter system of claim 6, wherein, for each said counter section, the one or more respective portable equipment pedestals comprise a first portable equipment pedestal and a second portable equipment pedestal, and wherein the first and second portable equipment pedestals, when positioned adjacent to each other within the equipment pedestal bay, substantially fill the respective equipment pedestal bay of the counter section.

8. The modular counter system of claim 7, wherein each of the portable equipment pedestals defines a respective plurality of equipment storage spaces therein for holding equipment to be used at the counter.

9. The modular counter system of claim 8, wherein the equipment to be used at the counter comprises equipment for use in airport customer service.

10. The modular counter system of claim 6, wherein each said one or more portable equipment pedestal comprises respective wheels for moving the portable equipment pedestal over a floor and into the corresponding equipment pedestal bay of the counter.

11. The modular counter system of claim 1, wherein, for each said counter section, the respective upper panel is mounted to a respective vertical lift that is controllable to vertically move the upper panel to provide said vertical adjustment.

12. The modular counter system of claim 1, wherein the modular counter is configured as a standing counter.

13. The modular counter system of claim 1, further comprising a baggage weigh scale.

14. The modular counter system of claim 1, wherein for each said counter section, the one or more portable equipment pedestals comprises:

a first one or more portable equipment pedestals; and a second one or more portable equipment pedestals, wherein the first one or more portable equipment pedestals is swappable with the second one or more equipment pedestals.

15. A method for a modular counter system a plurality comprising counter sections, the modular counter system comprising at least one respective equipment pedestal bay being open at a front of one of the plurality of counter sections at least one vertically adjustable upper panel, each said upper panel having a respective work surface, and at least one respective shelf selectively extendable from a back of one of the at least one counter sections at a vertical position lower than a vertical position of the upper panel, the method comprising:

for each said equipment pedestal bay, providing a respective first one or more portable equipment pedestals;

for each said equipment pedestal bay, moving the respective first one or more portable equipment pedestals into the equipment pedestal bay; and vertically adjusting a position of one or more of said at least one upper panel.

16. The method of claim 15, further comprising, for each said equipment pedestal bay, replacing at least one of the first respective first one or more portable equipment pedestals with a second one or more portable equipment pedestals.

17. The method of claim 16, wherein the first one or more portable equipment pedestals comprises equipment configured for a first user and the second one or more portable equipment pedestals comprises equipment configured for a second user.

18. The method of claim 16, wherein the first one or more portable equipment pedestals comprises equipment configured for a first customer service and the second one or more portable equipment pedestals comprises equipment configured for a second customer service.

19. The modular counter system of claim 1, wherein the shelf is selectively extendable between a retracted position, in which the shelf extends a first distance from the back of the counter, and an extended position, in which the shelf extends a second distance from the back of the counter, the second distance being greater than the first distance.

* * * * *